US007716762B2

(12) United States Patent
Ferraresi et al.

(10) Patent No.: US 7,716,762 B2
(45) Date of Patent: May 18, 2010

(54) BED WITH SACRAL AND TROCHANTER PRESSURE RELIEVE FUNCTIONS

(75) Inventors: Rodolfo W. Ferraresi, Cumming, GA (US); Eduardo Rene Benzo, Celina (AR); Mario Cesar Eleonori, Martinez (AR)

(73) Assignee: Bedlab, LLC, Cumming, GA (US)

( * ) Notice: Subject to any disclaimer, the term of this patent is extended or adjusted under 35 U.S.C. 154(b) by 0 days.

(21) Appl. No.: 12/249,114

(22) Filed: Oct. 10, 2008

(65) Prior Publication Data

US 2009/0094746 A1 Apr. 16, 2009

Related U.S. Application Data

(60) Provisional application No. 60/979,837, filed on Oct. 14, 2007.

(51) Int. Cl.
*A47B 7/00* (2006.01)

(52) U.S. Cl. ..... 5/612; 5/609; 5/618; 5/610; 5/607

(58) Field of Classification Search ..... 5/608, 5/609, 610, 612, 613, 617, 618, 120, 640
See application file for complete search history.

(56) References Cited

U.S. PATENT DOCUMENTS

| | | | |
|---|---|---|---|
| 2,113,286 | A | 4/1938 | White |
| 2,168,649 | A | 8/1939 | Johnson |
| 2,534,471 | A | 12/1950 | Norheim |
| 2,613,371 | A | 10/1952 | Keyes |
| 2,906,259 | A | 9/1959 | Adair |
| 3,013,281 | A | 12/1961 | Steiner |
| 3,132,351 | A | 5/1964 | Huntress et al. |
| 3,302,218 | A | 2/1967 | Stryker |
| 3,434,165 | A | 3/1969 | Keane |
| 3,701,170 | A | 10/1972 | Bond |
| 3,737,924 | A | 6/1973 | Davis |
| 3,827,089 | A | 8/1974 | Grow |
| 3,875,598 | A | 4/1975 | Foster et al. |
| 4,084,274 | A | 4/1978 | Willis et al. |
| 4,085,471 | A | 4/1978 | DiMatteo et al. |
| 4,094,024 | A | 6/1978 | Benoit et al. |

(Continued)

FOREIGN PATENT DOCUMENTS

BR PI 0100713-0 A 9/2001

(Continued)

OTHER PUBLICATIONS

Levytar, "Multimedia: In this section you will find visual materials on our products," "Levytar: The unique electronic rotation bed," 2004 (c), pp. 1-2, published at http://levytar.com/Ingles/Multimedia.htm.

(Continued)

*Primary Examiner*—Peter M Cuomo
*Assistant Examiner*—Brittany M Wilson
(74) *Attorney, Agent, or Firm*—Eric W. Cernyar

(57) ABSTRACT

An adjustable bed comprises a patient support structure supporting a patient support surface that comprises separately adjustable torso and hip support structures. Lifting mechanisms are provided to elevate the torso and hip support structures to substantially reduce pressure on the sacral area of a patient resting on the patient support surface.

20 Claims, 16 Drawing Sheets

U.S. PATENT DOCUMENTS

| | | | | |
|---|---|---|---|---|
| 4,109,329 | A | 8/1978 | Tupper | |
| 4,114,209 | A | 9/1978 | Sandlin | |
| 4,175,550 | A | 11/1979 | Leininger | |
| 4,244,358 | A | 1/1981 | Pyers | |
| 4,277,857 | A | 7/1981 | Svehaug | |
| 4,357,722 | A | 11/1982 | Thompson | |
| 4,375,706 | A | 3/1983 | Finnhult | |
| 4,395,786 | A | 8/1983 | Casey et al. | |
| 4,432,353 | A | 2/1984 | Vrzalik | |
| 4,451,944 | A | 6/1984 | James | |
| 4,463,463 | A | 8/1984 | Kaneko | |
| 4,554,930 | A | 11/1985 | Kress | |
| 4,578,833 | A | 4/1986 | Vrzalik | |
| 4,658,450 | A | 4/1987 | Thompson | |
| 4,658,451 | A | 4/1987 | Taniguchi | |
| 4,685,159 | A | 8/1987 | Oetiker | |
| 4,763,643 | A | 8/1988 | Vrzalik | |
| 4,866,796 | A | 9/1989 | Robinson et al. | |
| 4,868,937 | A | 9/1989 | Connolly | |
| 4,872,657 | A | 10/1989 | Lussi | |
| 4,949,801 | A | 8/1990 | Schaal et al. | |
| 5,005,231 | A | 4/1991 | Lonardo | |
| 5,005,240 | A | 4/1991 | Vrzalik | |
| 5,018,712 | A | 5/1991 | Schaefer | |
| 5,023,967 | A | 6/1991 | Ferrand | |
| 5,095,562 | A | 3/1992 | Alexander | |
| 5,103,511 | A | 4/1992 | Sequin | |
| 5,142,719 | A | 9/1992 | Vrzalik | |
| 5,152,024 | A | 10/1992 | Chrones et al. | |
| 5,181,288 | A | 1/1993 | Heaton et al. | |
| 5,224,228 | A | 7/1993 | Larrimore | |
| 5,230,113 | A | 7/1993 | Foster et al. | |
| 5,269,031 | A | 12/1993 | Alexander | |
| 5,274,862 | A | 1/1994 | Palmer, Jr. et al. | |
| 5,299,334 | A | 4/1994 | Gonzalez | |
| 5,502,853 | A | 4/1996 | Singleton et al. | |
| 5,515,561 | A | 5/1996 | Suggitt et al. | |
| 5,611,096 | A | 3/1997 | Bartlett et al. | |
| 5,613,252 | A | 3/1997 | Yu et al. | |
| 5,640,729 | A | 6/1997 | Marino | |
| 6,038,717 | A | 3/2000 | Persson | |
| 6,282,736 | B1 | 9/2001 | Hand et al. | |
| 6,287,253 | B1 | 9/2001 | Ortega et al. | |
| 6,341,393 | B1 | 1/2002 | Votel | |
| 6,360,386 | B1 | 3/2002 | Chuang | |
| 6,374,435 | B1 | 4/2002 | Leininger et al. | |
| 6,502,260 | B2 | 1/2003 | Viljoen et al. | |
| 6,536,056 | B1 | 3/2003 | Vrzalik et al. | |
| 6,561,047 | B1 | 5/2003 | Gladney et al. | |
| 6,651,281 | B1 | 11/2003 | Jacob | |
| 6,691,348 | B2 | 2/2004 | Plummer et al. | |
| 6,892,405 | B1 | 5/2005 | Dimitriu | |
| 2005/0160530 | A1 * | 7/2005 | Taguchi et al. | 5/610 |
| 2005/0166323 | A1 * | 8/2005 | Kawakami et al. | 5/610 |
| 2009/0089930 | A1 | 4/2009 | Benzo | |
| 2009/0094744 | A1 | 4/2009 | Benzo | |
| 2009/0094745 | A1 | 4/2009 | Benzo | |

FOREIGN PATENT DOCUMENTS

| | | |
|---|---|---|
| EP | 0674893 B1 | 1/2002 |

OTHER PUBLICATIONS

Levytar, "Products: CM 2000 Model," "Levytar: The unique electronic rotation bed," 2004 (c), pp. 1-2, published at http://levytar.com/Ingles/CM2000.htm.

Levytar, "Products: AC 2000 Model," "Levytar: The unique electronic rotation bed," 2004 (c), pp. 1-2, published at http://levytar.com/Ingles/AC2000.htm .

Discovery Channel, Video entitled "Levytar —Discovery Channel (on AC 2000)," Jun. 14, 2004, available at http://levytar.com/Ingles/Levytar.WVM.

Levytar, Video entitled "Levytar S.A. (on CM 2000)," Jul. 19, 2004, available at http://levytar.com/Ingles/Levytar_Spa.WVM.

Levytar, Animation entitled "Levytar—Camera," Sep. 15, 2004, available at http://levytar.com/Ingles/Levytar_Anima_Camara.WVM.

Levytar, Animation entitled "Levytar—Demo 1," Sep. 15, 2004, available at http://levytar.com/Ingles/Levytar_Anima_Demo.WVM.

Levytar, Animation entitled "Levytar—Demo 2," Sep. 15, 2004, available at http://levytar.com/Ingles/Levytar_Anima_Demo_2.WVM.

Levytar, Animation entitled "Levytar—Demo 3," Sep. 15, 2004, available at http://levytar.com/Ingles/Levytar_Anima_Demo_3.WVM.

Levytar, Animation entitled "Levytar—Lateral," Sep. 15, 2004, available at http://levytar.com/Ingles/Levytar_Anima_Lateral.WVM.

Levytar, Animation entitled "Levytar—Perspectiva," Sep. 15, 2004, available at http://levytar.com/Ingles/Levytar_Anima_Perspectiva.WVM.

Levytar, Powerpoint entitled "Levytar III AC 2000," Feb. 18, 2002.

Non-literature prior art—54 Photographs of the Levytar Bed, Feb. 5, 2005 (The photographs are not published "literature," but the photographed bed set forth in this document is prior art).

* cited by examiner

BED WITH SACRAL AND TROCHANTER PRESSURE RELIEVE FUNCTIONS

RELATED APPLICATIONS

This application claims priority to, and incorporates herein by reference, our U.S. provisional patent application, application Ser. No. 60/979,837, filed on Oct. 14, 2007, entitled "Adjustable Bed With Sacral Pressure Relieve Function."

FIELD OF THE INVENTION

This invention relates generally to specialized therapeutic beds and surfaces, and more particularly, to beds with mechanically adjustable therapeutic surfaces for the treatment and prevention of a patient immobility induced complications.

BACKGROUND OF THE INVENTION

A normal person, while sleeping, generally turns or moves frequently. This mobility restores blood circulation to the compressed areas of the subcutaneous tissues. When a patient is partially or permanently immobilized, the blood supply in the area under pressure is restricted or blocked. If the blood supply is not restored it will be predisposed to induce local injury, which might lead to decubitus or pressure ulcers (bedsores). Pressure sores occur most commonly in the buttocks, sacrum, hips and heels. When infected, these sores can become life threatening. Besides pressure ulcers, immobility can cause other pathologies including pneumonia, atelectasis, thrombosis, urinary tract infections, muscle wasting, bone demineralization and other undesired events.

To prevent such complications, many medical care facilities buy or rent extraordinarily expensive beds and therapeutic support surfaces, costing upwards of seventy-five thousand dollars each or more than $100/day in rent. Other medical and nursing care facilities rely on nurses and aides to turn bedridden patients manually, preferably at least every 2 hours—day and night—to relieve tissue compression and reestablish blood flow. Both alternatives put a significant strain on limited medical care resources.

The manual procedure, in particular, has many drawbacks. The need to frequently turn and move patients is costly, and requires an increased ratio of personnel to patient. The immobilized patient is also awakened every time he is mobilized. If family members are the caregivers, they need to be in attendance 24 hours a day, which might lead to fatigue and distress.

Many attempts have been made to solve the above-mentioned problems utilizing mattresses filled with air, water or gel. These solutions generally fall into one or both of two categories—very expensive solutions, and inadequate or unreliable solutions. Today, the medical bed industry has largely abandoned strictly or predominantly mechanical approaches in favor of costly therapeutic support surfaces that use managed multi-compartment air mattresses to distribute pressure and laterally rotate the patient. Thus, there is still a very great need for fresh, less costly solutions to problems of patient immobility. There is also a great need for improved ways of both preventing ulcers and treating patients with existing ulcers.

SUMMARY OF THE INVENTION

An adjustable bed is provided with lifting mechanisms operable to modulate the patient support surface to relieve pressure on the sacral area of a patient resting on the patient support surface.

In one embodiment, the patient support structure comprises a torso support structure, a pelvic support structure, an upper-leg support structure, and a lower-leg support structure. Lifting mechanisms are operable to elevate the torso and upper-leg support structures relative to the pelvic support section sufficiently to substantially reduce pressure on the sacral area of a patient resting on the patient support surface. These lifting mechanisms are also operable to modulate the patient support surface to create a trough that relieves pressure on the sacral area of the patient or on the heads of the patient's trochanters if the patient is tilted to one side.

The torso support, upper-leg support and lower-leg support structures are each operable to articulate about separate transverse axes of articulation. The torso support structure comprises a patient support litter mounted on a torso support base structure. Likewise, the upper-leg support structure comprises another patient support litter mounted on an upper-leg support base structure. Each patient support litter comprises a mattress-supporting foundation or hammock mounted on two bars on the right and left sides of the corresponding (torso support or upper-leg support) base structure. The patient support litter mounted on the torso support base structure is mounted on telescoping bars that are mounted on four independently controllable vertices (right and left lower thorax support vertices and right and left shoulder support vertices) situated near the four corners of the torso support base structure. The patient support litter mounted on the upper-leg support base structure is mounted between non-telescoping right and left side support bars which are pivotally joined to two independently controllable hip support vertices mounted on an articulating hip support base structure.

In a sacral-pressure-relief mode, several mechanisms are coordinated to create a trough that relieves pressure on the sacral area of the patient. Both the articulating torso support base structure and the articulating upper-leg support base structure are rotated moderately upward. Also, the right and left lower thorax support vertices of the torso support structure move along upward and inward trajectories—and independently of the right and left shoulder support vertices—to cradle and elevate the patient's lower thorax. Furthermore, the upper-leg support bars are elevated by—while pivoting with respect to—the corresponding vertices to lift the patient's hips and upper legs. The elevation of the lower thorax and upper leg support vertices, relative to the pelvic support structure, reduces pressure on the sacral area of the patient.

In a trochanter-pressure-relief mode, several mechanisms are coordinated to both create a trough in the patient support surface and tilt the patient to one side. As with the sacral-pressure-relief mode, both the articulating torso support base structure and the articulating upper-leg support base structure are rotated moderately upward. The right and left lower thorax support vertices of the torso support structure move along upward and inward trajectories—and independently of the right and left shoulder support vertices—to help create a trough. The upper-leg support vertices also move along upward and inward trajectories to help create the trough. Once a suitable trough has been created to cradle the patient's midsection, the lower thorax and upper-leg support vertices on one side of the bed are selectively further elevated (with respect to the lower thorax and upper-leg support vertices on the other side of the bed), causing the patient to tilt toward her left or right side.

Each of the vertices is driven by an independently operable actuator. Many different preferred embodiments of independently operable actuators are shown. One embodiment of an independently operable actuator, illustrated in FIG. 11, comprises screw-type linear actuator driving a sliding element, a sliding guide that confines the movement of the sliding element to a horizontal linear segment within the transverse plane perpendicular to the longitudinal axis of the torso-supporting or hip-supporting base structure, and a principal arm having superior and inferior ends, the inferior end of which is hingedly linked to the sliding element, and the superior end of which is joined to a side support bar corresponding to the independently operable actuator of which the principal arm is a part. This embodiment also includes a secondary arm having superior and inferior ends, the inferior end of which is hingedly linked to the torso-supporting or hip-supporting base structure and the superior end of which is hingedly joined to a midsection of the principal arm.

Another embodiment of an independently operable actuator, illustrated in FIG. 12, includes many of the elements of the embodiment of FIG. 11, and further includes a principal arm that comprises an inner rod that telescopes within an outer rod. A second linear actuator is operable to drive the telescoping inner rod of the principal arm.

Another embodiment of an independently operable actuator, illustrated in FIGS. 13-14, has a principal arm—like that of FIG. 12—that comprises an inner rod that telescopes within an outer rod. But the embodiment of FIGS. 13-14 uses one linear actuator, whereas the embodiment of FIG. 12 uses two. Rather than having a linear actuator at the base of the principal arm operable to drive the telescoping inner rod of the principal arm, the embodiment of FIGS. 13-14 uses a cord connected on one end to the telescoping inner rod and on an opposite end to a spring, the cord being mounted, at one or more intermediate points along the cord, on a one or more pulleys, the cord being operable to cause the telescoping inner rod of the principal arm to extend. In this embodiment, activation of the same actuator that moves the position of the sliding element also causes the telescoping inner rod of the principal arm to extend or retract.

Another embodiment of an independently operable actuator, illustrated in FIG. 15, includes a telescoping principal arm having superior and inferior ends, the inferior end of which is hingedly linked to the hip-supporting base structure, and the superior end of which is joined to the support arm corresponding to the independently operable actuator of which the telescoping principal arm is a part. This embodiment also includes a telescoping secondary arm having superior and inferior ends, the inferior end of which is hingedly linked to the hip-supporting base section and the superior end of which is hingedly joined to a midsection of the principal telescoping arm. In this embodiment, each of the principal and secondary telescoping arms comprises an inner rod, driven by a linear actuator, that telescopes within an outer rod. This embodiment eliminates the sliding element of the previous three embodiments.

A further embodiment of an independently operable actuator, illustrated in FIGS. 16-17, comprises a curved arm sliding within a curved guide and a linear actuator hingedly mounted on one end to the hip-supporting base structure and on an opposite end to the curved arm that is operable to move the curved arm between retracted and extended positions.

Yet another embodiment of an independently operable actuator, illustrated in FIG. 18, comprises a curved arm sliding within a curved guide, gear teeth disposed along a concave surface of the curved arm, and a rotary actuator with gear teeth adapted to mesh with the gear teeth of the curved arm, the rotary actuator being operable to drive the curved arm between retracted and extended positions.

DETAILED DESCRIPTION

In describing preferred and alternate embodiments of the technology described herein, as illustrated in FIGS. 1-35, specific terminology is employed for the sake of clarity. The technology described herein, however, is not intended to be limited to the specific terminology so selected, and it is to be understood that each specific element includes all technical equivalents that operate in a similar manner to accomplish similar functions.

I. Mechanical Overview

A. Main Structures of the Adjustable Bed

Figure 1:
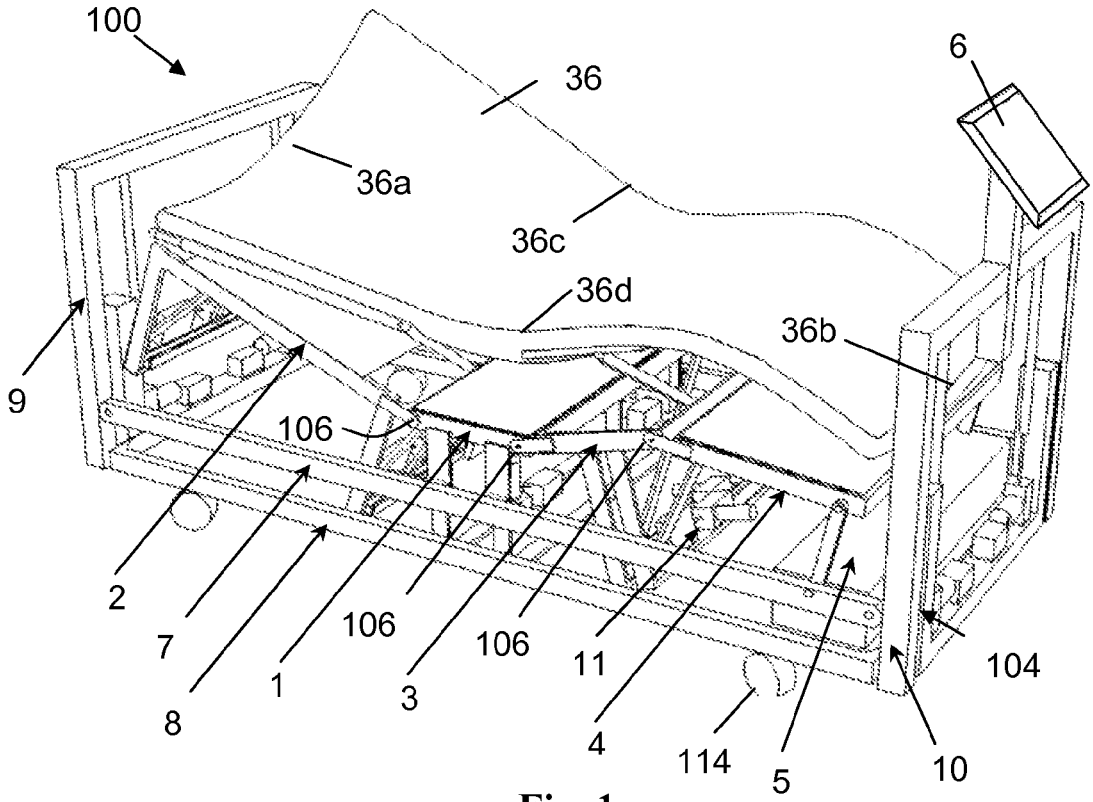
FIG. 1 illustrates a perspective view of one embodiment of the adjustable bed, adapted especially for a hospital environment.
Figure 2:
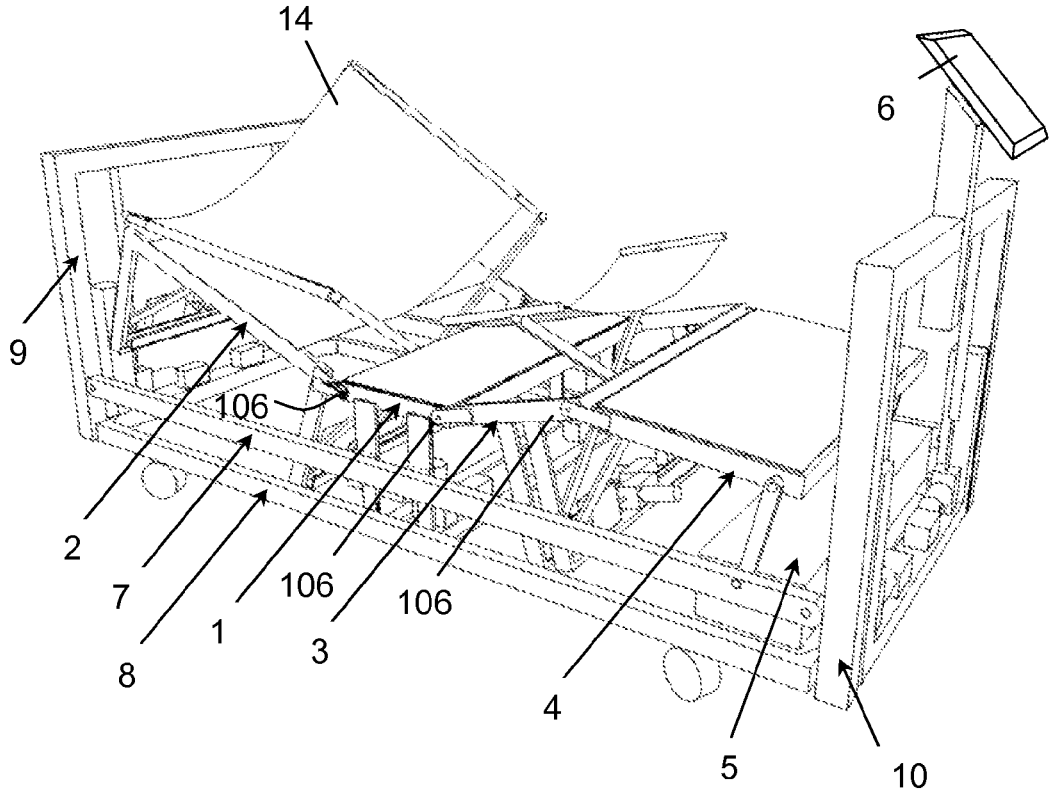
FIG. 2 illustrates a perspective view of the adjustable bed of FIG. 1 with the overlying patient support surface removed.

FIG. 1 illustrates a perspective view of a preferred embodiment of an adjustable bed 100 embodied as a hospital bed and that offers support to a patient weighing as much as 1000 pounds. The adjustable bed 100 comprises a patient support surface 36 that extends from the edge of the headboard 9 to the edge of the footboard 10. The patient support surface 36 overlays a versatile patient support structure 60 (FIG. 3)—discussed in much greater detail in the following sections—that supports and modulates the patient support surface 36. This patient support structure 60 is mounted on an upper chassis 7, which is in turn mounted on a lower chassis 8. The lower chassis 8 is mounted on wheels 114. The headboard 9 and footboard 10 are attached to opposite ends of the upper chassis 7.

A prototype version of the adjustable bed 100 has a length of about 248 cm. and a width of about 107 cm. The patient support surface 36 is 91 cm. wide. It is anticipated that bariatric versions of the adjustable bed 100 would have a width of about 137 to 153 cm.

Mechanical linear actuators 104 (FIGS. 1, 3) positioned between the upper chassis 7 and a lower chassis 8 allow the head and foot ends of the upper chassis to be independently raised or lowered with respect to the lower chassis 8. To adjust the elevation of the patient support surface 36, all of the linear actuators 104 are synchronously activated to uniformly raise or lower both the headboard 9 end and the footboard 10 end of the upper chassis 7 with respect to the lower chassis 8. To incline the bed 100 into a Trendelenburg position, with the feet higher than the head, the footboard linear actuators 104 are activated to raise the footboard 10 end of the upper chassis 7. To incline the bed 100 into a reverse-Trendelenburg position, with the head higher than the feet, the headboard linear actuators 104 are activated to raise the headboard 8 end of the upper chassis 7. Accordingly, the upper chassis can be moved between raised, lowered, Trendelenburg, and reverse-Trendelenburg positions.

In other embodiments, not shown here, side guard rails may be added to the upper chassis 7, and specially designed attachments may be provided to increase the width of the patient support structure 60 to accommodate bariatric patients. For example, side guards of the type shown and described in our U.S. patent application Ser. No. 12/176,338, filed on Jul. 19, 2008 and entitled "Side Guard for Bed" may be included on the adjustable bed 100.

Figure 5:
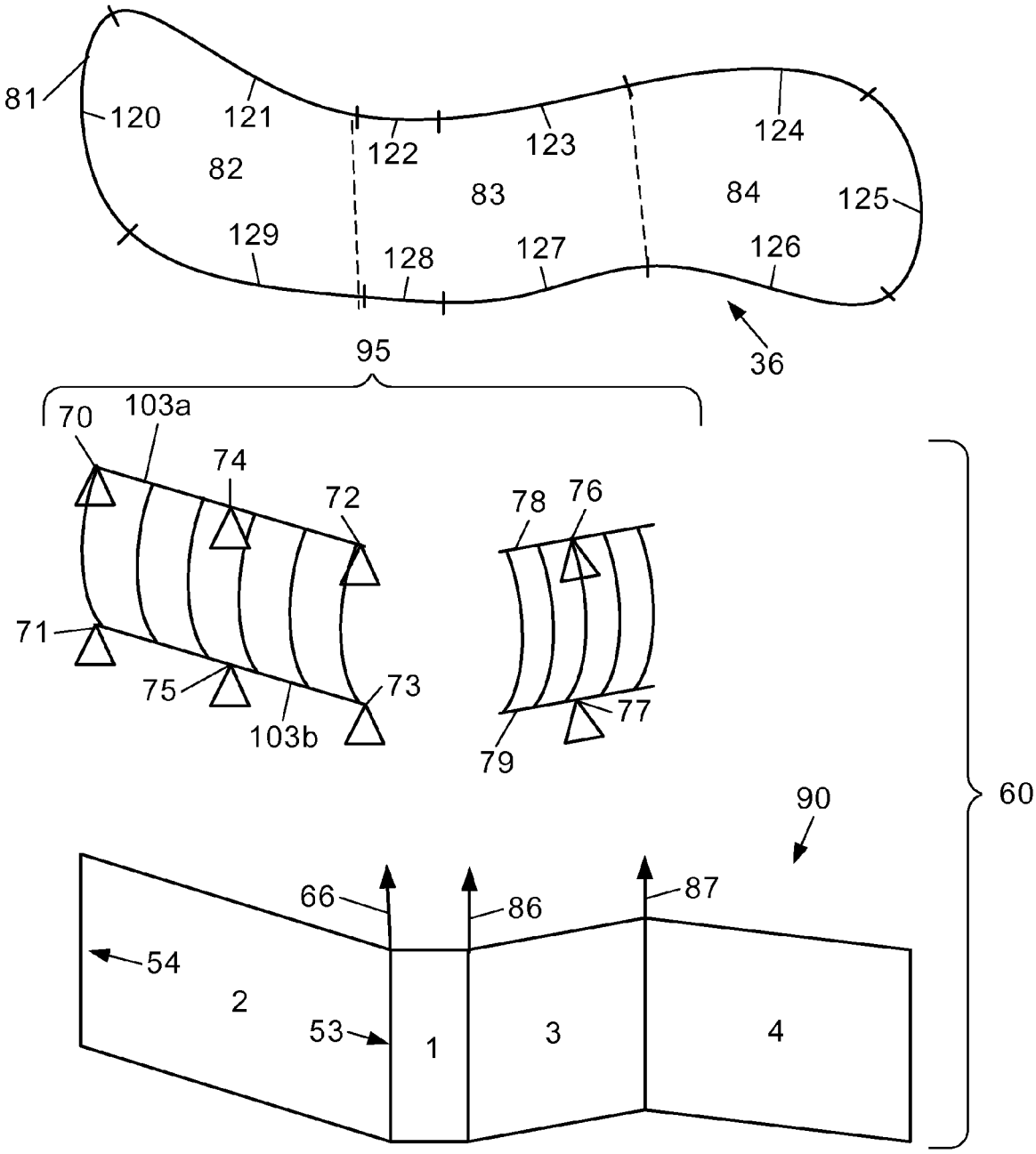
FIG. 5 is an exploded-view schematic diagram illustrating the relationship between the articulating multisectioned base platform of the patient support platform, the adjustable patient support framework of the patient support platform, and the patient support surface, which is modulated by movement of points and segments oriented at or near its periphery.

The patient support surface 36 is highly flexible in order to conform to several different configurations of the bed 100. The patient support surface 36 may comprise a polyurethane foam mattress or, optionally, a mattress filled with air, water or gel. The density and thickness of the patient support surface 36 may be selected based on the weight and condition of the patient. The patient support surface 36 is characterized by a head end 36*a*, a foot end 36*b*, a right side 36*c*, a left side 36*d* (FIG. 1), and an upper-body supporting section 82, a midsection 83, and a lower-body supporting section 84 (FIG. 5).

The patient support surface 36 is operable to be modulated into numerous configurations through manipulation of points and segments along the periphery 81 (FIG. 5) of the patient support surface 36. The periphery 81 of the patient support surface 36 consists of a head-side peripheral portion 120 adjoining a right-torso-adjacent peripheral portion 121 adjoining an intermediate right-side peripheral portion 122 adjoining a right-hip-adjacent peripheral portion 123 adjoining a right-calf-adjacent peripheral portion 124 adjoining a foot-side peripheral portion 125 adjoining a left-calf-adjacent peripheral portion 126 adjoining a left-hip-adjacent peripheral portion 127 adjoining an intermediate left-side peripheral portion 128 adjoining a left-torso-adjacent peripheral portion 129 adjoining the head-side peripheral portion 120. The patient support surface 36 has sufficient flexibility so that desired modulations of the patient support surface 36 can be effected through movements of the patient support structure 60 that reposition multiple points and segments along the periphery 81 of the patient support surface 36.

B. Basic Components of the Patient Support Structure Used to Modulate the Patient Support Surface.

This specification characterizes the patient support structure 60 (FIG. 5) used to modulate the patient support surface 36 in two different ways. From a top-down perspective, this specification characterizes the patient support structure 60 as an adjustable patient support framework 95 mounted on an articulatable, multi-sectioned base platform 90. From a headboard-to-footboard perspective, this specification characterizes the patient support structure 60 as a combination of a plurality of adjacent lateral patient support structures.

The top-down perspective best illustrates two conceptually independent mechanisms by which the patient support structure 60 modulates the patient support surface 36. First, the patient support structure 60 comprises an articulatable, multi-sectioned base platform 90 having several sections that are operable to articulate relative to each other. Second, the patient support structure 60 comprises an adjustable patient support framework 95 mounted on the base platform 90. The adjustable patient support framework 95 comprises a plurality of independently movable points, vertices, or nodes oriented at or near the periphery 81 of the patient support surface 36. The adjustable patient support framework 95 also comprises several fixed-length or variable-length telescoping side support segments, oriented longitudinally along the periphery of the patient support surface 36, that are pivotally connected to these points or nodes. A combination of articulation of the base platform 90 and adjustment of the patient support framework 95 modulates the patient support surface 36.

The headboard-to-footboard perspective best illustrates the mechanical interrelationships of the components of the patient support structure 60. From this perspective, best illustrated in FIG. 3, the patient support structure 60 comprises an articulatable torso support structure 62 hingedly adjoining a preferably non-articulatable central or pelvic support structure 1 hingedly adjoining an articulatable hip and upper-leg support structure 63 hingedly adjoining an articulatable lower-leg support structure 4.

Figure 6:
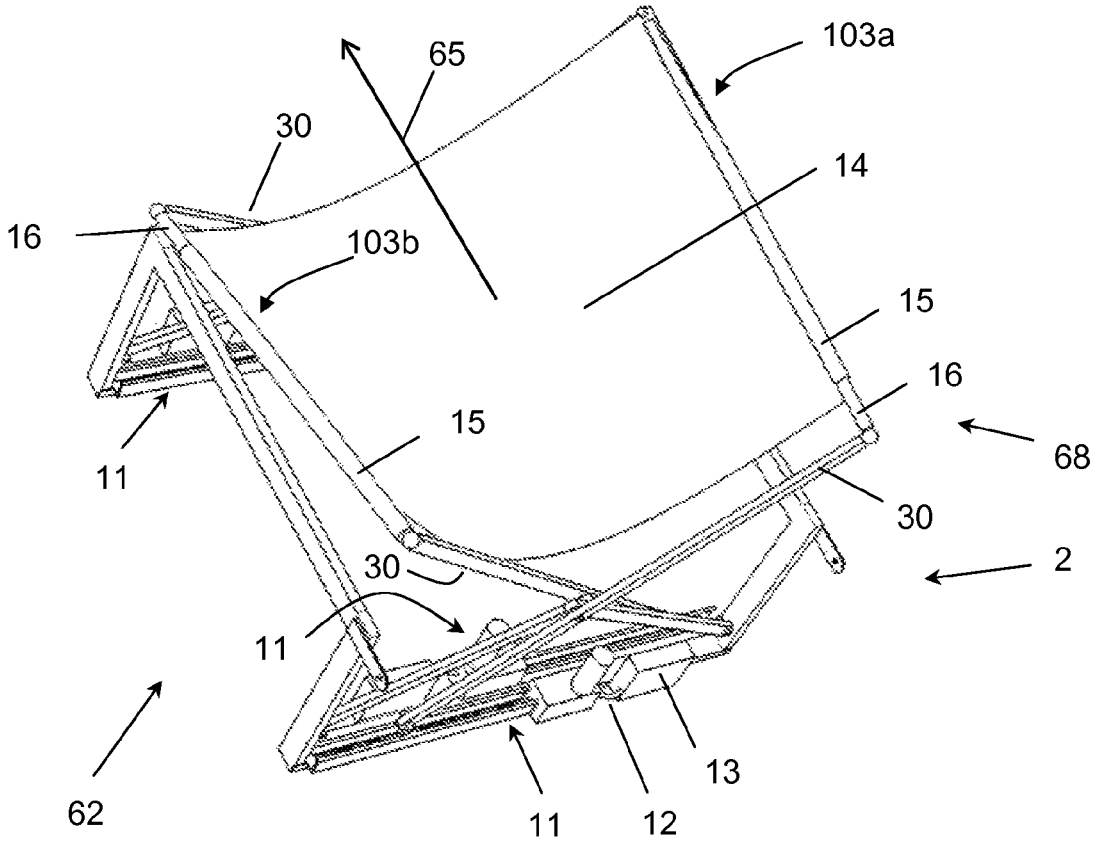
FIG. 6 illustrates a perspective view of the torso support structure of the adjustable bed.
Figure 7:
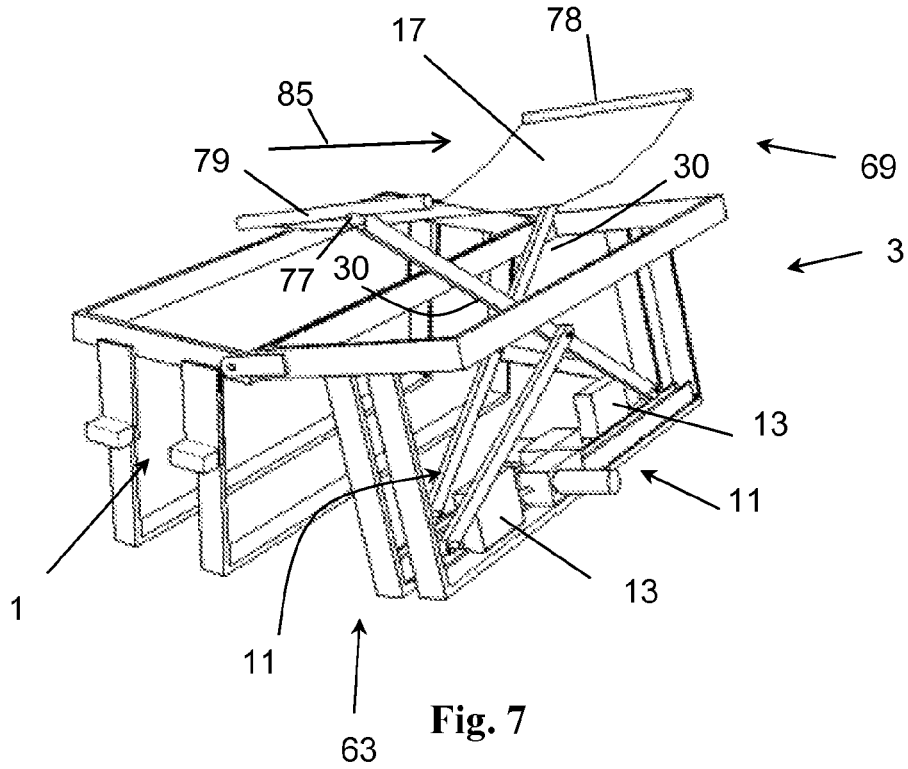
FIG. 7 illustrates a perspective view of the hip support structure and the central support structure of the adjustable bed.

Continuing with the headboard-to-footboard perspective, each of the substructures of the patient support structure 60 supports a different part of a patient lying on the patient support surface 36. The articulatable torso support structure 62, shown by itself in FIG. 6, is positioned to support the patient's torso and head. The articulatable hip and upper-leg support structure 63, shown in FIG. 7, is positioned to support the patient's hip and upper legs. The articulatable lower-leg support structure 4 (FIG. 1) is positioned to support the patient's lower legs. The central or pelvic support structure 1 (FIGS. 1, 3, 7), which is preferably rigidly attached to the upper chassis 7 between the hingedly adjoining torso support structure 62 and the hingedly adjoining hip and upper-leg support structure 63, is positioned to support—or relieve pressure upon, as explained in connection with FIGS. 23-24—the pelvic area of the patient.

Figure 3:
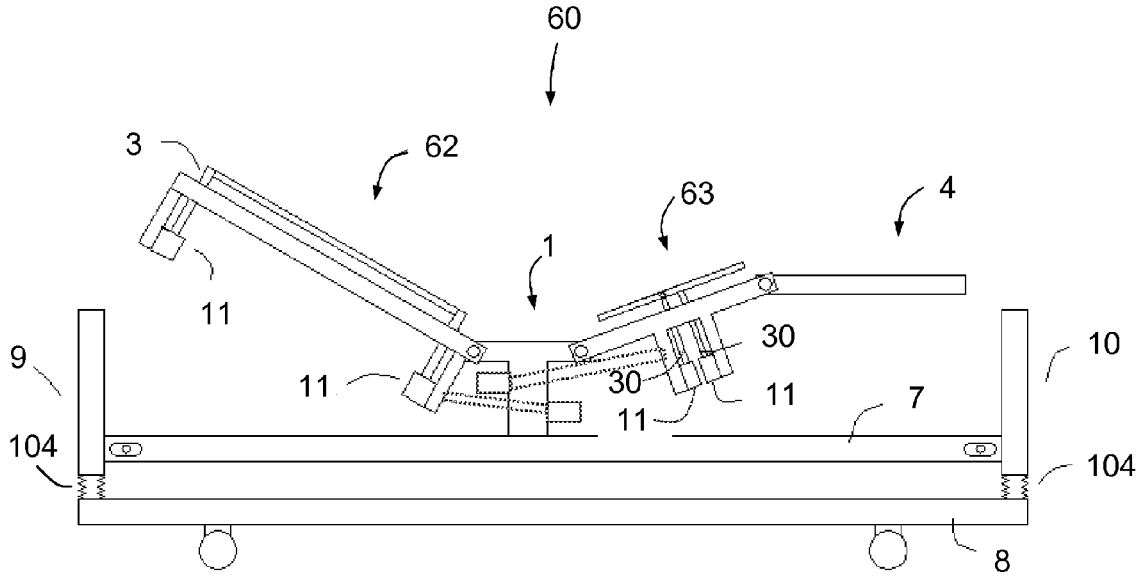
FIG. 3 illustrates a side view of the patient support structure and upper and lower chasses of the adjustable bed of FIG. 1.
Figure 4:
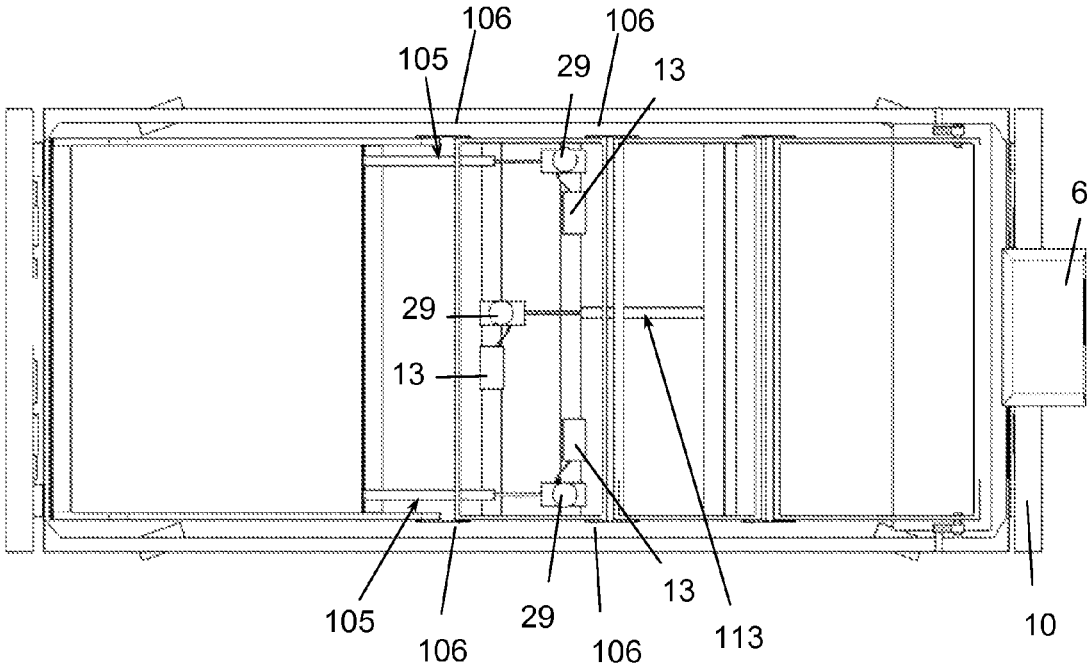
FIG. 4 illustrates a partial top plan view of linear actuators for torso elevation and leg elevation.

As shown in FIGS. 3 and 4, a hinge 106 connects the inferior side of the torso support structure 62 to the central support structure 1 and allows the torso support structure 62 to be rotated about transverse axis 66 (FIG. 5) for torso elevation. Another hinge 106 connects the superior side of the hip support structure 63 to the central support structure 1 and allows the hip support structure 63 to be rotated about transverse axis 86 for elevation of the patient's upper legs. Yet another hinge 106 connects the superior side of the lower-leg support structure 4 to the hip support structure 63 and allows the lower-leg support structure 4 to be rotated about transverse axis 87 for flexing of the legs and/or elevation of the lower legs.

Linear actuators 105 mounted between the central support structure 1 and the torso support structure 62 drive and rotate the torso support structure 62 about an axis 66 (FIG. 5) defined by hinge 106 (coinciding with a transversal axis of the bed 100). Another linear actuator 113 mounted between the central support structure 1 and the hip support structure 63 drives and rotates the hip support structure 63 about an axis 86 (FIG. 5) defined by hinge 106 (also coinciding with a transversal axis of the bed 100). Electric motors 29, each activated by a peripheral control unit 13, drive each of the linear actuators 105 and 113. Alternatively, various types of actuators, including hydraulic and pneumatic actuators, replace the electric motors 29.

Returning to the top-down perspective, the torso support structure 62 and the hip and upper-leg support structure 63 each comprise versatile support litters mounted upon articulating base structures. In particular, and as shown in FIG. 6, the torso support structure 62 comprises an adjustable torso support litter 68 mounted on an articulatable torso support base structure 2. As shown in FIG. 7, the hip and upper-leg support structure 63 comprises an adjustable hip and upper leg support litter 69 mounted on an articulatable hip support base structure 3.

The adjustable torso support litter 68 and the adjustable hip and upper leg support litter 69 together make up the adjustable patient support framework 95. The combination of the torso support base structure 2 (which articulates about transverse axis 66 (FIG. 5)), the preferably non-articulating central or pelvic support structure 1, the hip support base structure 3 (which articulates about transverse axis 86), and the lower-leg support structure 4 (which articulates about transverse axis 87) make up the articulatable, multi-sectioned base platform 90.

Focusing specifically on the torso support structure 62 (FIG. 6), four movable arms 30 are attached to the ends of two side support bars 103*a* and 103*b*. Independently controllable actuator assemblies 11 mounted on the torso support base structure 2 are drivingly connected to the moveable arms 30 and provide means to move the side support bars or segments 103 in both vertical and lateral directions to modulate the patient support surface 36 in various ways. For example, the independently controllable actuator assemblies 11 are operable to induce rotational movement of the patient about a longitudinal axis 65 of the torso support structure 62.

Figure 8:
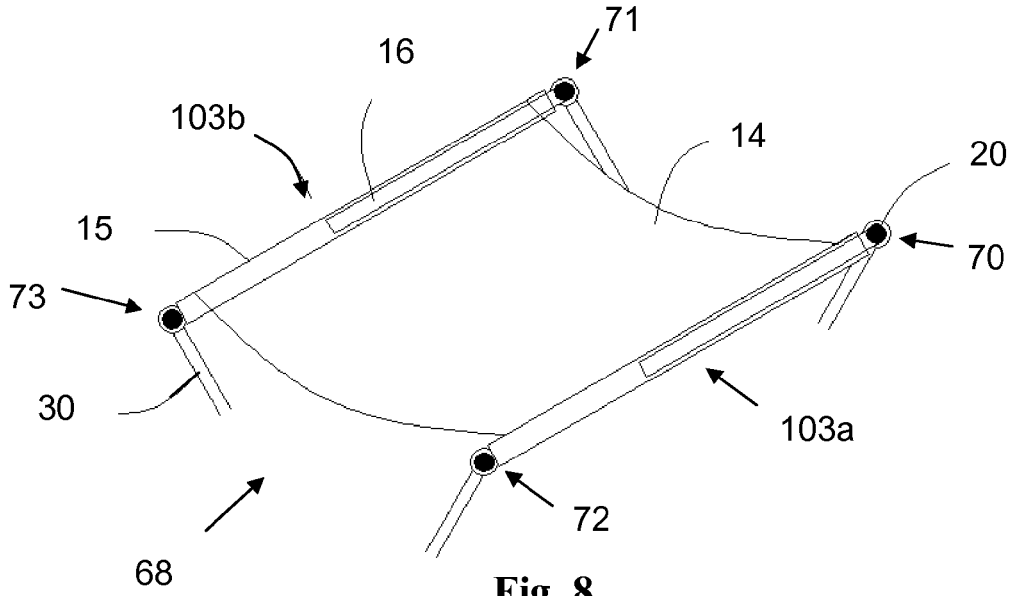
FIG. 8 illustrates the adjustable torso support litter of FIG. 6.
Figure 9:
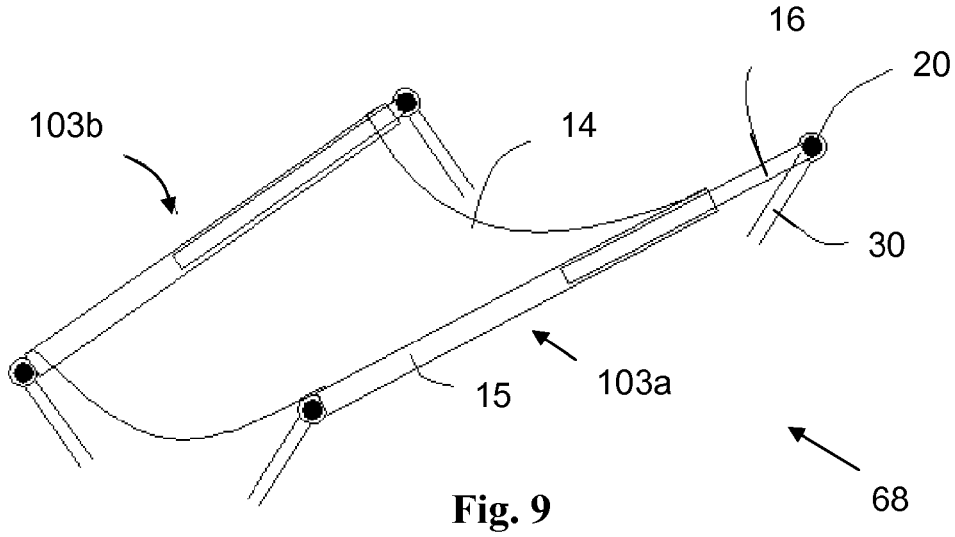
FIG. 9 further illustrates the adjustable torso support litter of FIG. 8, in a different orientation.

FIGS. 8 and 9 illustrate the adjustable torso support litter 68 of the torso support structure 62 in further detail. The adjustable torso support litter 68 comprises four independently movable points or vertices: a right side shoulder support vertex 70, a left side shoulder support vertex 71, a right side lower thorax support vertex 72, and a left side lower thorax support vertex 73. The shoulder support vertices 70, 71 are located on the superior or upper end 54 of the torso support structure 62, close to the head end 36*a* of the patient support surface 36. Movement of each of these vertices 70-73 is accomplished by operation of an independently controllable actuator assembly 11 (FIG. 6), which is coupled by a movable arm 30 to, and operable to independently raise, its respective vertex 70, 71, 72, or 73. Each actuator assembly 11 is operable to independently raise its respective vertex 70, 71, 72, or 73 relative to the other vertices.

Each of the vertices 70-73 comprises a pivotal joint 20 that connects its respective movable arm 30 (FIG. 6) to one end of a side support bar 103*a* or 103*b*. More particularly, a right side support bar 103*a* connects the right side shoulder support vertex 70 to the right side lower thorax support vertex 72, and a left side support bar 103*b* connects the left side should support vertex 71 to the left side lower thorax support vertex 73. A flexible mattress-supporting foundation 14—which provides support to the corresponding portion (i.e., torso area) of the patient support surface 36—is mounted to the side support bars 103*a* and 103*b*. As illustrated in the sectional diagram of FIG. 5, the right and left side lower thorax support vertices 72 and 73 are oriented near the lower or inferior end 53 of the torso support structure 62, near the intersection between the upper-body supporting section 82 and the mid-section 83 of the patient support surface 36.

To increase the range of motion of each of the vertices 70-73, and to reduce bending forces and torsional loads on the movable arms 30, the right and left side support bars 103*a* and 103*b* preferably have adjustable lengths. In a preferred embodiment, this is accomplished by providing that each right and left side support bar 103*a* and 103*b* comprise an inner rod 16 that telescopes or slides within an outer rod 15 (FIG. 8).

FIG. 3 illustrates the relative location of the torso support section actuator assemblies 11 that control the position of each of the vertices 70-73. As shown in FIG. 3, the actuator assemblies are positioned on the inferior and superior ends 53 and 54 of the torso support structure 62. This provides a radiolucent area, between the inferior and superior ends 53 and 54, free of metallic parts and mechanical obstructions for taking X-rays of the thorax of a patient resting on the patient support surface 36.

FIGS. 8 and 9 also illustrate a flexible mattress-supporting foundation or hammock 14 that consists essentially of a sheet mounted on the right and left side support bars 103*a* and 103*b* and stretched between the four vertices 70, 71, 72, and 73. Alternatively, the flexible mattress-supporting foundation 14 may comprise a plurality of straps, bands or belts (preferably slightly elastic) (not shown) affixed to and bridging the side support bars 103*a* and 103*b*. Also alternatively, the flexible mattress-supporting foundation 14 may be incorporated within the wrapping of the patient support surface 36, and secured to the side support bars 103*a* and 103*b* through straps or clamps (not shown). The flexible mattress-supporting foundation 14 may alternatively comprise a net or any other suitable material.

FIG. 7 illustrates the hip support structure 63 and also the central support structure 1 to which it is connected. Two independently controllable actuator assemblies 11 are mounted on the hip support base structure 3, and drivingly connected to the moveable arms 30 of the adjustable hip and upper-leg support litter 69.

Figure 10:
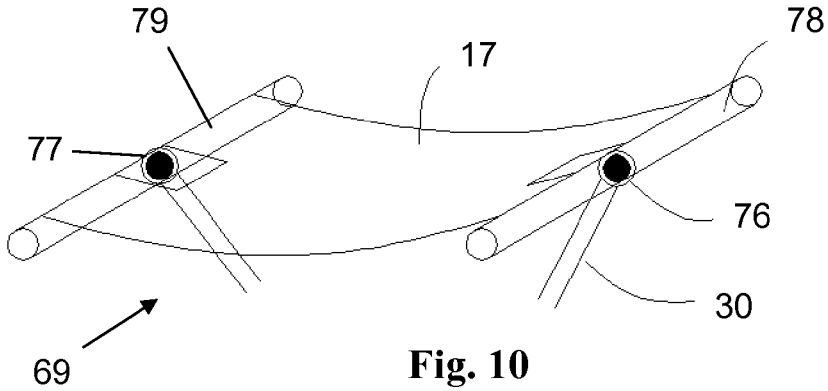
FIG. 10 illustrates the adjustable hip support litter of FIG. 7.

FIG. 10 further illustrates the adjustable hip and upper-leg support litter 69 of the hip support structure 63. The adjustable hip and upper-leg support litter 69 comprises two independently movable vertices 76 and 77 that are respectively pivotally joined to a right side support bar 78 and a left side support bar 79. Each vertex 76 and 77 is pivotally coupled to a movable arm 30. Selective operation of the independently controllable actuator assemblies 11 (FIG. 7), which are coupled to respective movable arms 30, selectively raises a respective side support bar 78 or 79. This provides a means to move side support bars 78 and 79 in both vertical and lateral directions in such a way as to tilt, hug, or induce rotational movement of the a patient's hip and upper legs about a longitudinal axis 85 (FIG. 5).

A flexible mattress-supporting foundation or hammock 17 is mounted on and between side support bars 78 and 79. Like the flexible mattress-supporting foundation or hammock 14, the flexible mattress-supporting foundation or hammock 17 comprises a sheet, straps, netting, or any other suitable material.

The ability of the side support bars 78 and 79 to pivot with respect to vertices 76 and 77 maximizes the distribution of the patient's weight on the patient support surface 36 and also reduces shearing forces between the patient's body and the mattress in this zone. This is because the adopted position of the hips and upper legs of the patient define the angular orientation of the side support bars 78 and 79.

C. Independently Controllable Actuator Assemblies for the Torso and Hip Support Litters.

FIGS. 11-18 illustrate various embodiments of independently controllable actuator assemblies 11 mounted on the torso support base structure 2 or the hip support base structure 3 and operable to move the vertices 70-73 of the torso support litter 68 or the vertices 76 and 77 of the hip and upper-leg support litter 69.

Figure 11:
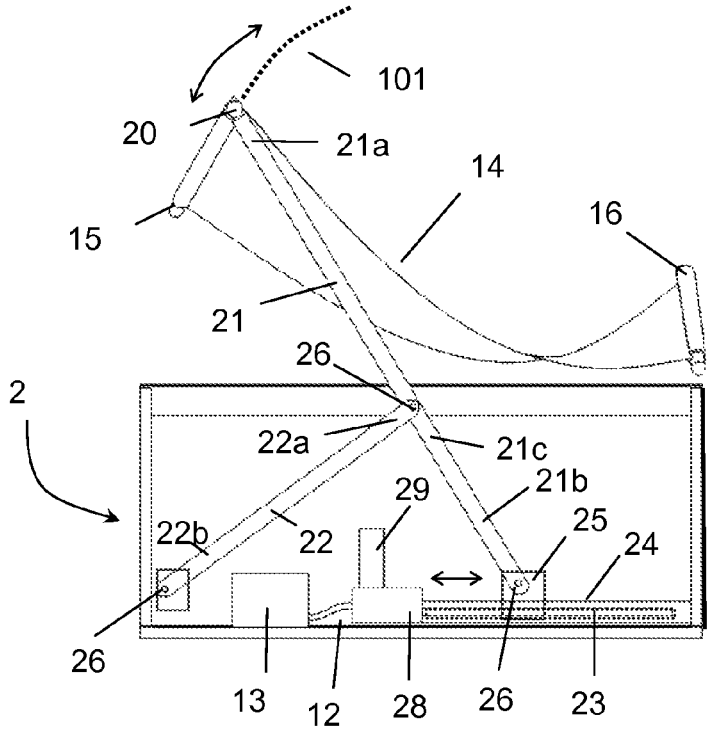
FIG. 11 illustrates a preferred embodiment of a mechanical actuator assembly to manipulate one of the vertices of the torso support structure.

FIG. 11 illustrates a mechanical lateral actuator 31 drivingly connected to a principal arm 21. The mechanical lateral actuator 31 comprises a sliding element 25 movable within a sliding guide 24. The inferior (i.e., lower) end 21*b* of the principal arm 21 is connected to the sliding element 25 via a hinge 26. The superior (i.e., upper) end 21*a* of the principal arm 21 is connected to the pivotal joint 20 that forms one of the torso support section vertices 70-73.

A secondary arm 22, having superior and inferior ends 22*a* and 22*b*, respectively, provides support to the principal arm 21. The superior end 22*a* of the secondary arm 22 is connected a midsection 21*c* of the principal arm 21 via a hinge 26. The inferior end 22*b* of the secondary arm 22 is attached to the torso support base structure 2 via another hinge 26. A screw 23 driven by an electric motor 29 and a mechanical reducer 28 advances or retreats the sliding element 25 within the sliding guide 24. A peripheral control unit 13 connected to motor 29 via cable 12 operates the motor 29.

Operation of the mechanical lateral actuator 11 causes the respective vertex 70, 71, 72, or 73 to travel along a characteristic path or trajectory 101. This characteristic path or trajectory 101—which more closely approximates a semi-parabolic arc than a semi-circular arc—is defined, in part, by the position of hinge 26 joining the secondary arm 22 to the principal arm 21. The approximately semi-parabolic trajectory yields more vertical than lateral displacement, and is better suited to rotating the patient than a semi-circular trajectory would be.

One embodiment of the lateral actuator 11 of FIG. 11, designed for a 91-cm-wide patient support surface 36, has a 91-cm-long principal arm 21 and a 50-cm-long secondary arm 22. Hinge 26 connecting the secondary arm 22 to the principal arm 21 is located 34 cm. from the inferior end 21*b* of the principal arm 21. The vertices driven by the mechanical lateral actuators 11 of FIG. 11 have 62 centimeters of vertical travel and 30 centimeters of lateral travel. They are also capable of tilting the patient support surface 36 to an angle of 40 degrees, measured between the horizontal and a line connecting two opposing vertices.

Figure 12:
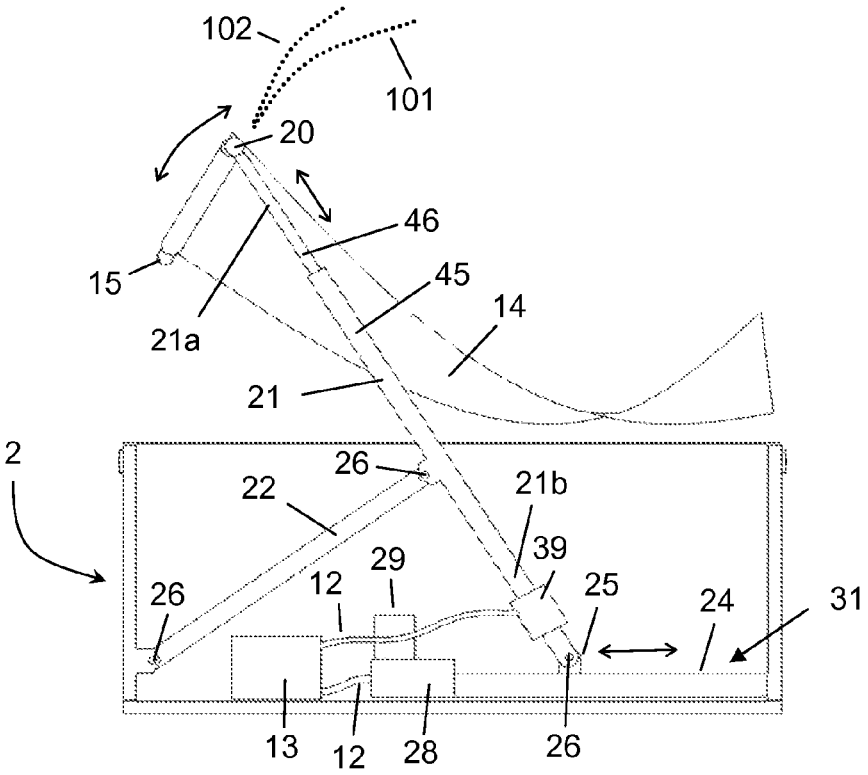
FIG. 12 illustrates a sectional rear plan view of another embodiment of a mechanical actuator assembly, incorporating a telescopic arm, to manipulate one of the vertices of the torso support structure.

FIG. 12 illustrates an alternative independently controllable actuator assembly, similar to the assembly depicted in FIG. 11 but having a telescoping principal arm 21 driven by an additional linear mechanical actuator 39. The additional linear mechanical actuator 39 causes an inner rod 46 of the principal arm 21 to telescope within a coaxial outer rod 45 of the principal arm 21. This gives the independently controllable actuator assembly of FIG. 12 two degrees of freedom with respect to the section 1, 2, 3, 4 of the base platform 90 to which the actuator assembly is mounted, facilitating extra displacement of joint 20 and increasing the range of motion of the assembly. In this embodiment, operation of the mechanical lateral actuator 31 together with linear mechanical actuator 39 causes the respective vertex 70, 71, 72, or 73 to travel along a selected and adjustable one of multiple characteristic paths or trajectories 101, 102, etc.

Figure 13:
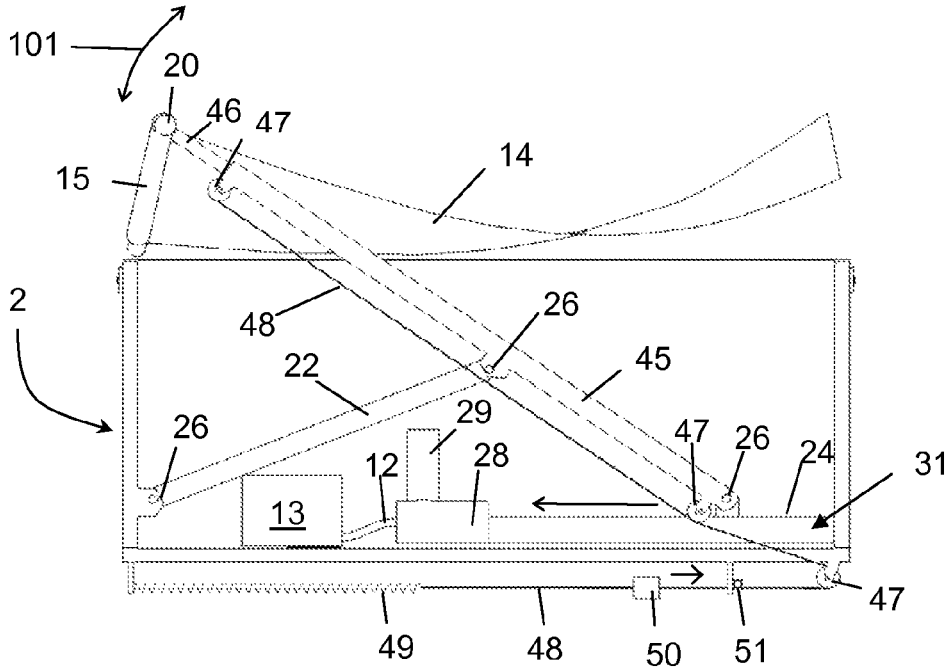
FIG. 13 illustrates yet another embodiment of a mechanical actuator assembly, incorporating a telescopic arm operated by a spring and steel cord, to manipulate one of the vertices of the torso support structure.
Figure 14:
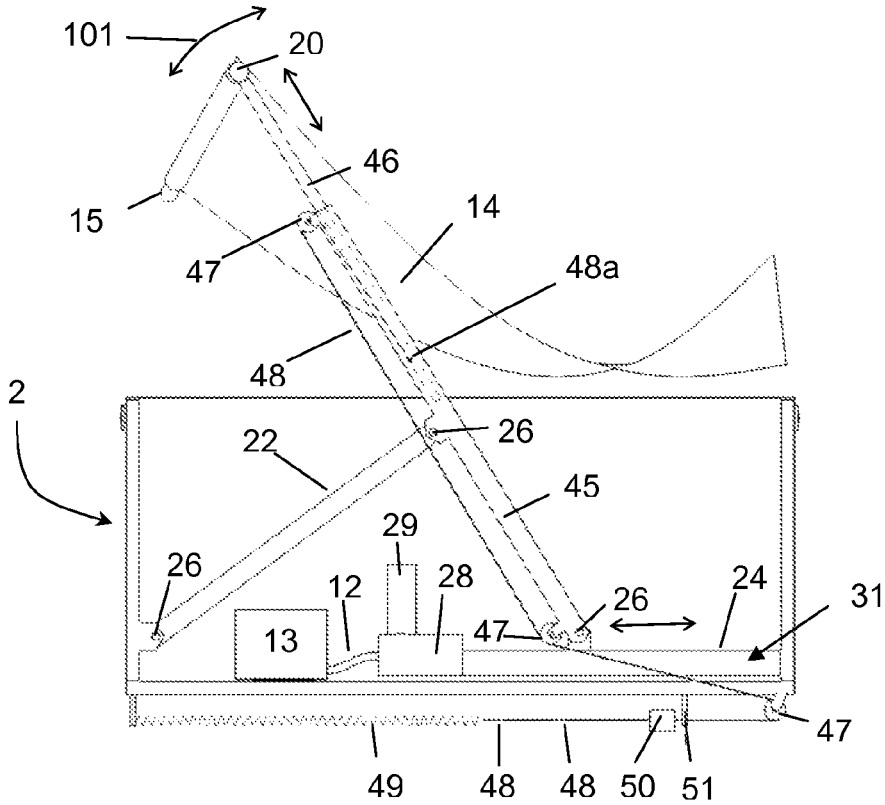
FIG. 14 illustrates the embodiment of FIG. 13 in the upper position.

FIGS. 13 and 14 illustrate another independently controllable actuator assembly. Like FIG. 12, this alternative assembly has a telescoping principal arm 21. But in FIGS. 13 and 14, a steel cord 48 mounted on several pulleys 47, and tensioned by a spring 49, drives the sliding action of the telescoping inner rod 46. One end 48*a* of the steel cord 48 is connected to the telescoping inner rod 46. The opposite end 48*b* of the steel cord 48 is connected to the spring 49. Operation of the mechanical lateral actuator 31 to raise the principal arm 21 increases the tension on the steel cord 48. This causes the spring 49 to stretch and the telescoping inner rod 46 to extend.

To further regulate the characteristic path or trajectory 101 about which the respective vertex 70, 71, 72, or 73 moves, a register 50 is secured to the steel cord 48, and the steel cord is threaded through a mechanical limit 51. When the register 50 meets the mechanical limit, further operation of the mechanical lateral actuator 31 to raise the principal arm 21 causes the steel cord 48 to exert traction action on the telescoping inner rod 46, thereby raising it. As the principal arm 21 is lowered, tension on the spring 49 is relieved, and the telescoping inner rod 46 retracts back into the coaxial outer rod 45. The position of the register 50 can be changed to adjust the desired characteristic path or trajectory 101.

In FIG. 13 shows the mechanism in a position in which the register 50 did not reach the mechanical limit 51. Accordingly, the telescoping inner arm 46 is fully retracted within the telescopic principal arm 45. FIG. 14 shows the mechanism in a position after the register 50 has reached the mechanical limit 51. Here, the telescoping inner rod 46 is in an extended position. As result of this action, the joint 20 is moved higher than it would otherwise be. This alternative assembly increases the range of motion of joint 20 in a more economical manner than shown in FIG. 12, using only one actuator.

Figure 15:
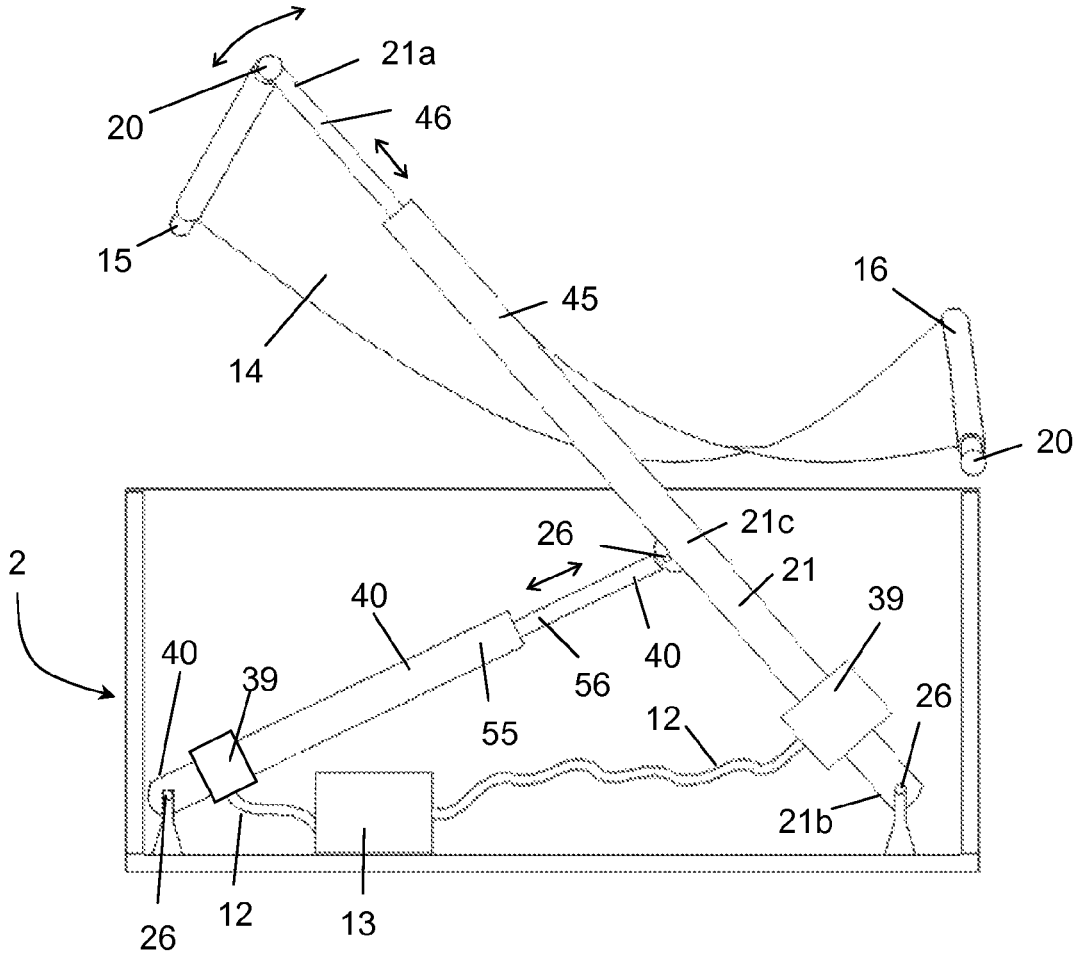
FIG. 15 illustrates a sectional rear plan view of yet another embodiment of a mechanical actuator assembly, utilizing two linear actuators driving telescoping principal and secondary arms, to manipulate one of the vertices of the torso support structure.

FIG. 15 illustrates yet another alternative independently controllable actuator assembly. This embodiment comprises a telescoping principal arm 21 and a telescoping secondary arm 40, each driven by a linear mechanical actuator 39. Moreover, the two linear mechanical actuators 39 in this embodiment substitute for the mechanical lateral actuator 31 shown in FIG. 11. The telescoping principal arm 21 comprises an inner rod 46, driven by a linear actuator 39, the telescopes within a coaxial outer rod 45. Likewise, the telescoping secondary arm 40 comprises an inner rod 56, also driven by a linear actuator 39, that telescopes within an outer rod 55. The inferior (i.e., lower) end 21*b* of the principal arm 21 is hingedly linked to the torso support base structure 2, while the superior (i.e., upper) end 21*a* of the principal arm 21 is joined to one of the torso support section vertices 70-73. The inferior end 40*b* of the telescoping secondary arm 40 is hingedly linked to the torso support base structure 2, while the superior end 40*a* of the telescoping secondary arm 40 is hingedly joined to a midsection 21*c* of the principal telescoping arm 21. Like the actuator assembly of FIG. 12, FIG. 15's actuator assembly provides two degrees of freedom with respect to the section 1, 2, 3, 4 of the base platform 90 to which the actuator assembly is mounted. FIG. 15's actuator assembly also enables a different set of adjustable characteristic paths or trajectories than those obtained by the mechanism shown in FIG. 12.

Figure 16:
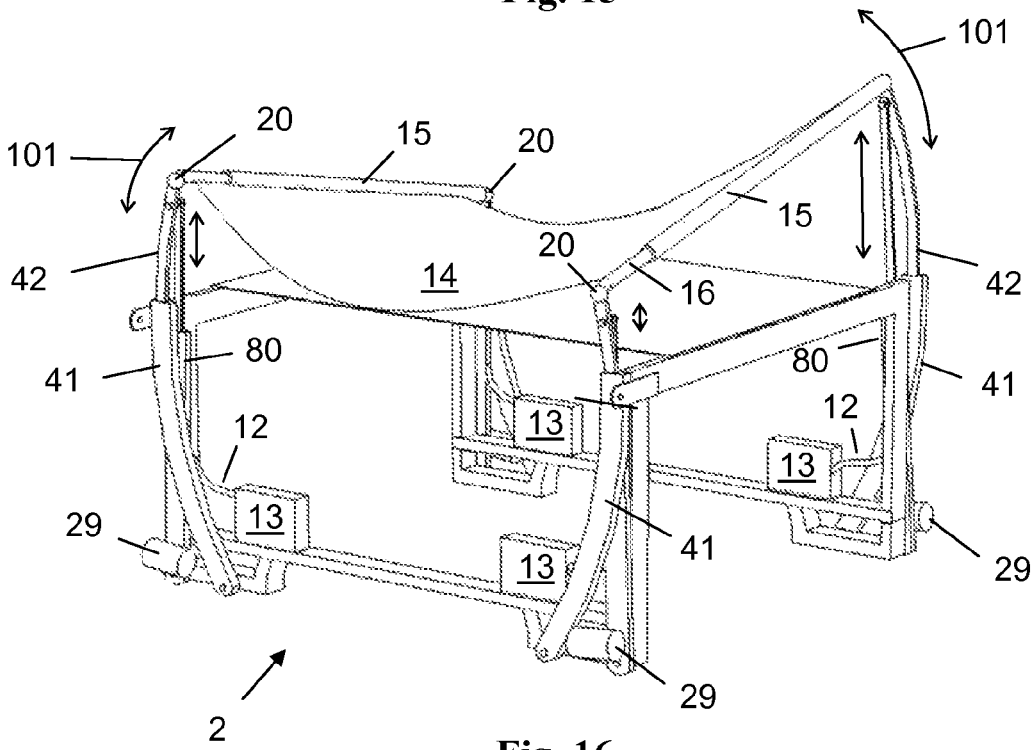
FIG. 16 illustrates a perspective view of a torso support structure using a curved telescoping arm and actuator assembly to manipulate the vertices of the torso support structure.
Figure 17:
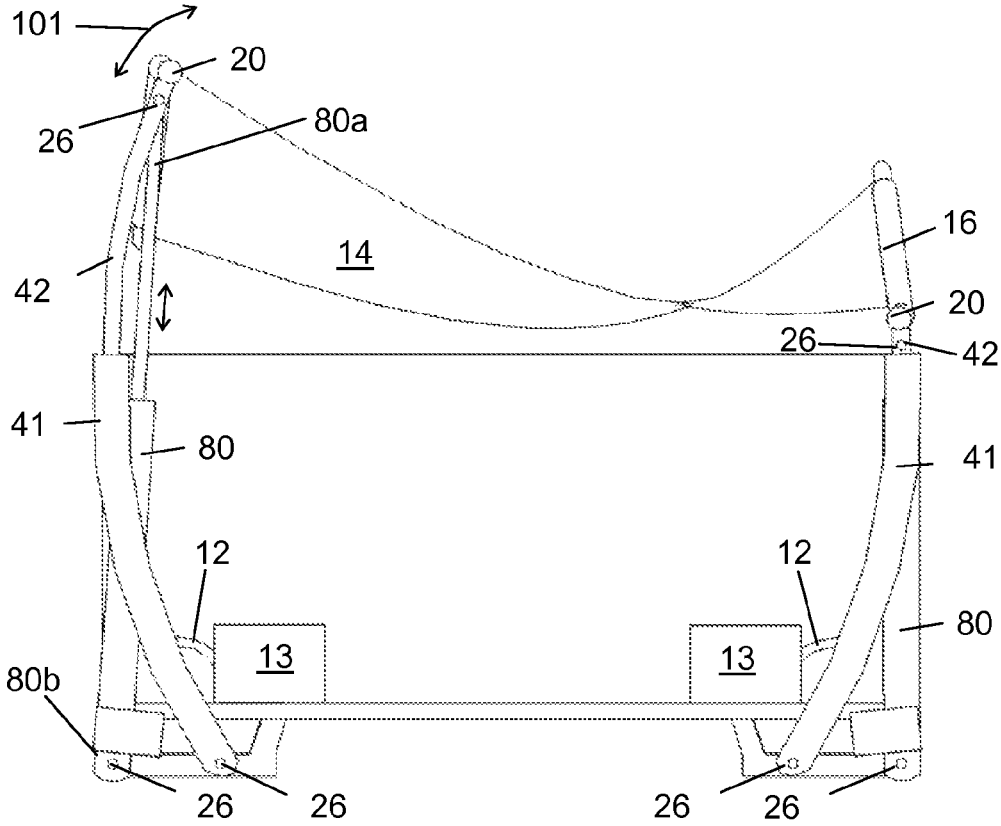
FIG. 17 illustrates a partial rear plan view of curved telescoping arm and actuator assembly of FIG. 16.

FIGS. 16 and 17 illustrate yet another independently controllable actuator assembly. Here, each independently controllable actuator assembly comprises a curved arm 42, sliding within a curved guide 41, driven by a linear actuator 80 mounted on one end 80*b* by a hinge 26 to the torso support base structure 2 and on an opposite end 80*a* by another hinge 26 to the curved arm 42. The linear actuator 80 is operable to move the curved arm 42 between retracted and extended positions, thereby displacing the associated joint 20. The curvature of the curved arm 42 and curved guide 41 define the characteristic path or trajectory 101 over which the joint 20 travels.

Figure 18:
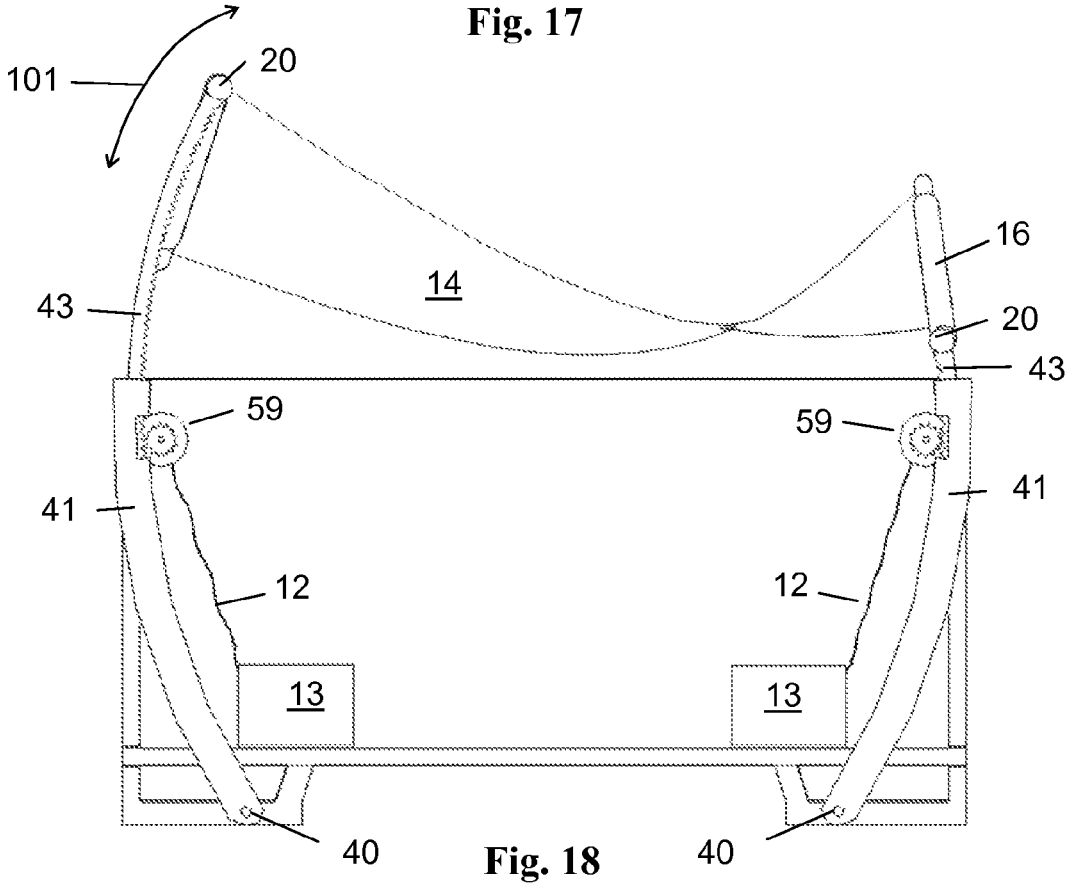
FIG. 18 illustrates a partial rear plan view of an alternative embodiment of the curved telescoping arm and actuator assembly of FIGS. 16 and 17, employing sliding arms with gears.

FIG. 18 illustrates a modification of the independently controllable actuator assembly depicted in FIGS. 16 and 17. In FIG. 18, a curved arm 43 with gear teeth disposed along its concave surface replaces the curved arm 22 of FIGS. 16 and 17. Moreover, a rotary actuator 59 with gear teeth adapted to mesh with the gear teeth of the curved arm 43 replaces the linear actuator 80 of FIGS. 16 and 17. The rotary actuator 59, which is affixed to the outside of the curved guide 41, is operable to drive the curved arm 43 between retracted and extended positions. This alternative has the advantage of a reduced number of parts.

Any of the independently controllable actuator assemblies depicted in FIGS. 11-18 for the torso support structure 62 can also be used for the hip support structure 63. Because these assemblies are sufficiently illustrated in FIGS. 11-18 with respect to the torso support structure 62, they are not separately depicted with equal detail with respect to the hip support structure 63.

Because the independently controllable actuator assemblies of FIGS. 11-18 are mounted on a common bed frame section, namely either the articulatable torso support base structure 2 or the articulatable hip support base structure 3, it will be observed that in the preferred embodiment, each of the actuator assemblies depicted therein comprises a plurality of moving parts whose movements, relative to the torso support base structure 2 or the hip support base structure 3, are confined to a transverse plane perpendicular to the longitudinal axis 65 or 85 (FIGS. 6, 7) of the torso support base structure 2 or hip support base structure 3. Moreover, in FIG. 11, it will be observed that the sliding guide 24 confines the movement of the sliding element 25 to a horizontal linear segment within the transverse plane perpendicular to the longitudinal axis 65 or 85 (FIGS. 6, 7) of the torso support base structure 2 or hip support base structure 3.

Because of the independent versatility of the independently controllable actuator assemblies, the adjustable bed 100 is operable to configure the patient support surface 36 in ways never previously done by hospital beds. FIG. 16 illustrates an example in which diagonally-opposed torso support section vertices 70, 73 are simultaneously raised while the other set of diagonally-opposed torso support section vertices 71, 72 are simultaneously lowered. The adjustable bed 100's actuators facilitate significant side-to-side tilting.

D. Alternative Embodiments of FIGS. 19-25

Figure 19:
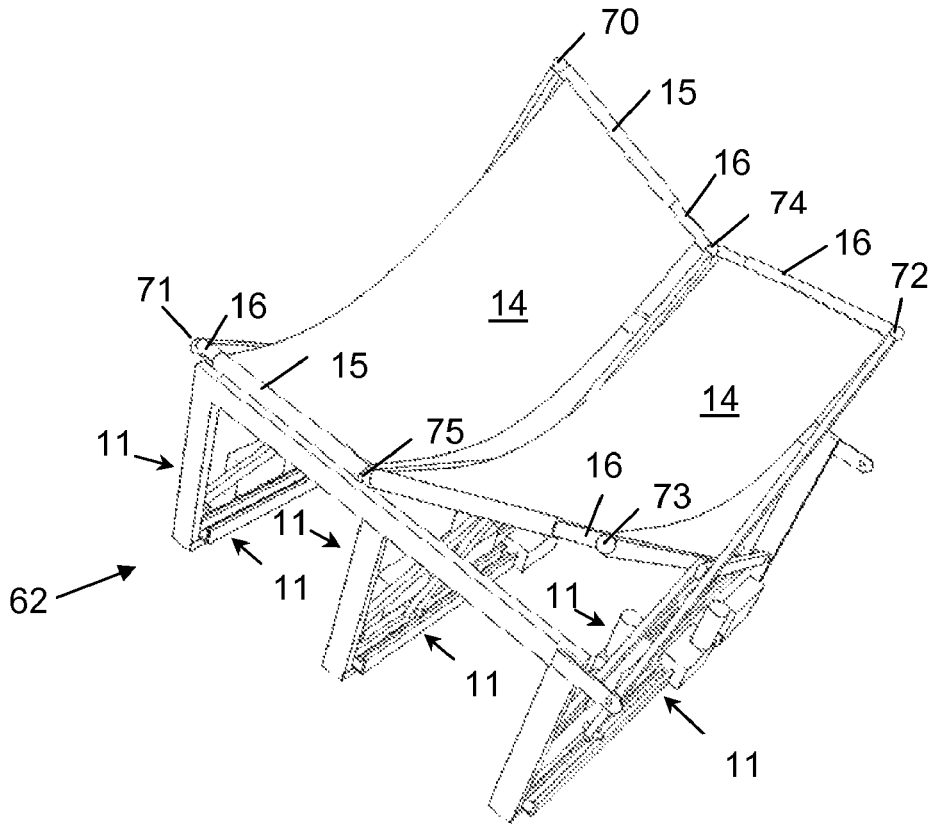
FIG. 19 illustrates a perspective view of another embodiment of a torso support structure that includes additional independently movable points or vertices of actuation.
Figure 20:
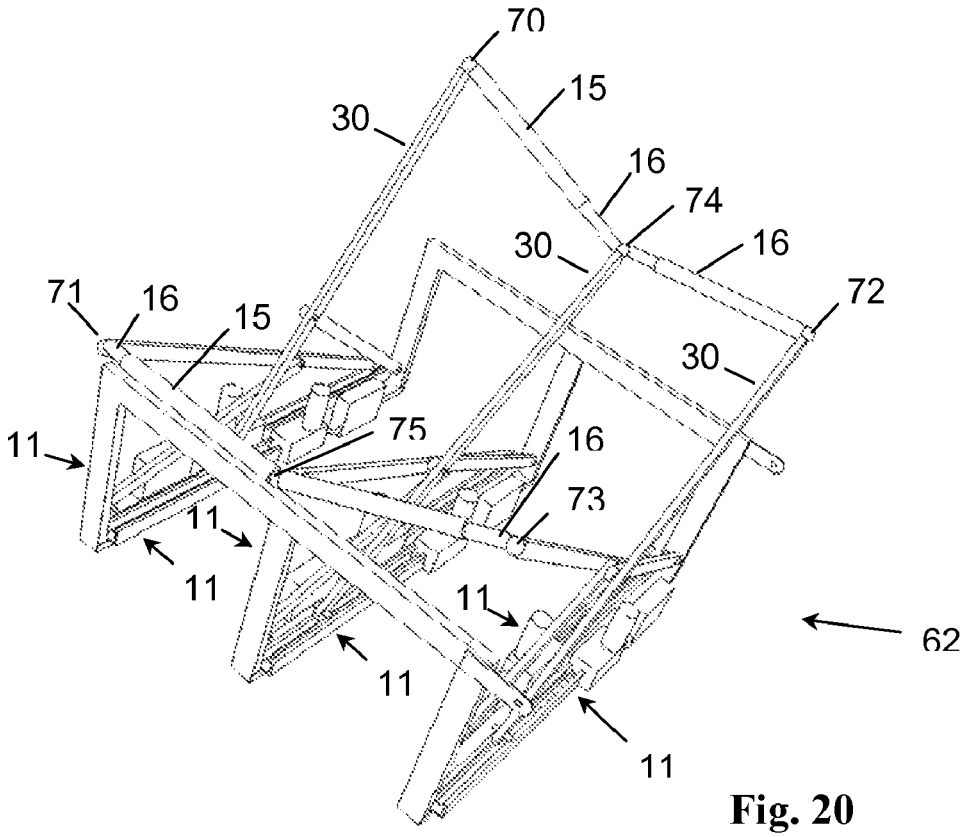
FIG. 20 illustrates FIG. 19 with the sheets removed for clarity.

FIGS. 19 and 20 illustrate a perspective view of a torso support structure 62 that incorporates two more independently movable points or vertices. In particular, the torso support structure 62 further comprises an intermediate right-side vertex 74 between the right side shoulder and lower thorax support vertices 70 and 72 and an intermediate left side vertex 75 between the left side shoulder and lower thorax support vertices 71 and 73. Each vertex 70-75 is defined by a joint 20. And each joint 20 is independently actuated by its own corresponding controllable actuator assembly 11. Two of these independently controllable actuator assemblies 11 are coupled to and operable to independently raise the intermediate right and left-side vertices 74 and 75 relative to the other vertices. In this embodiment, two flexible mattress-supporting foundations or hammocks 14 are incorporated for torso support.

Figure 21:
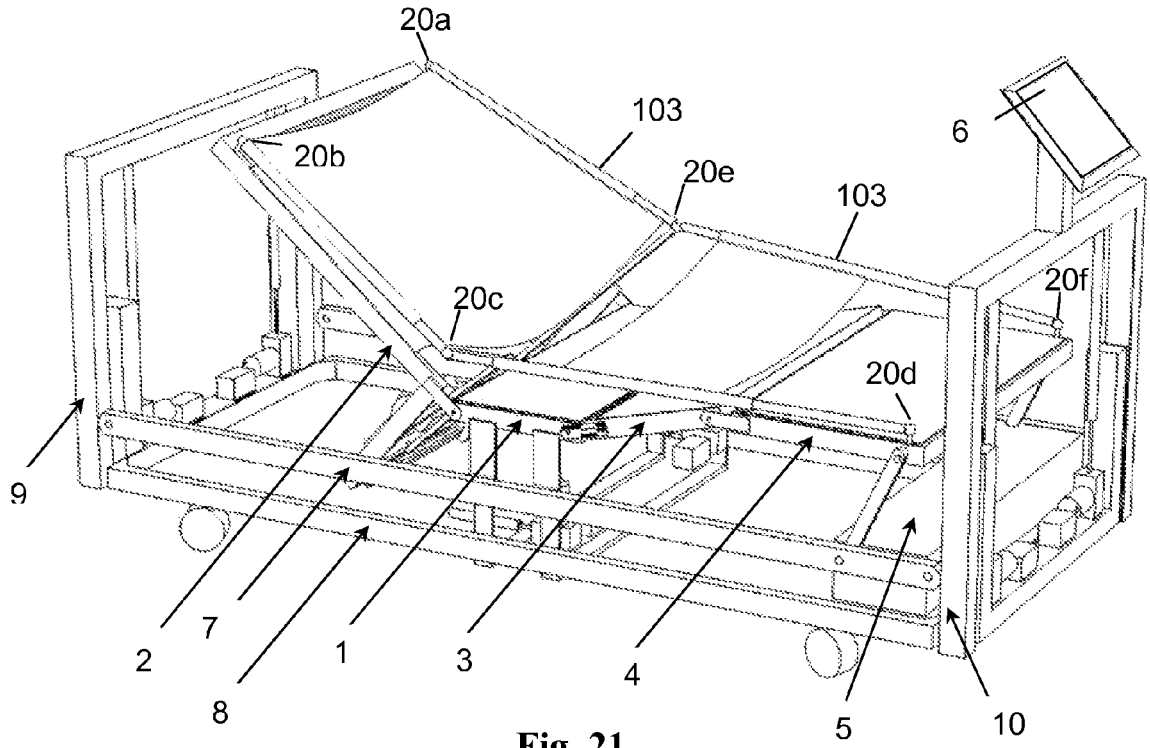
FIG. 21 illustrates a perspective view of a simplified adjustable bed 100 that is especially adapted to a home embodiment.
Figure 22:
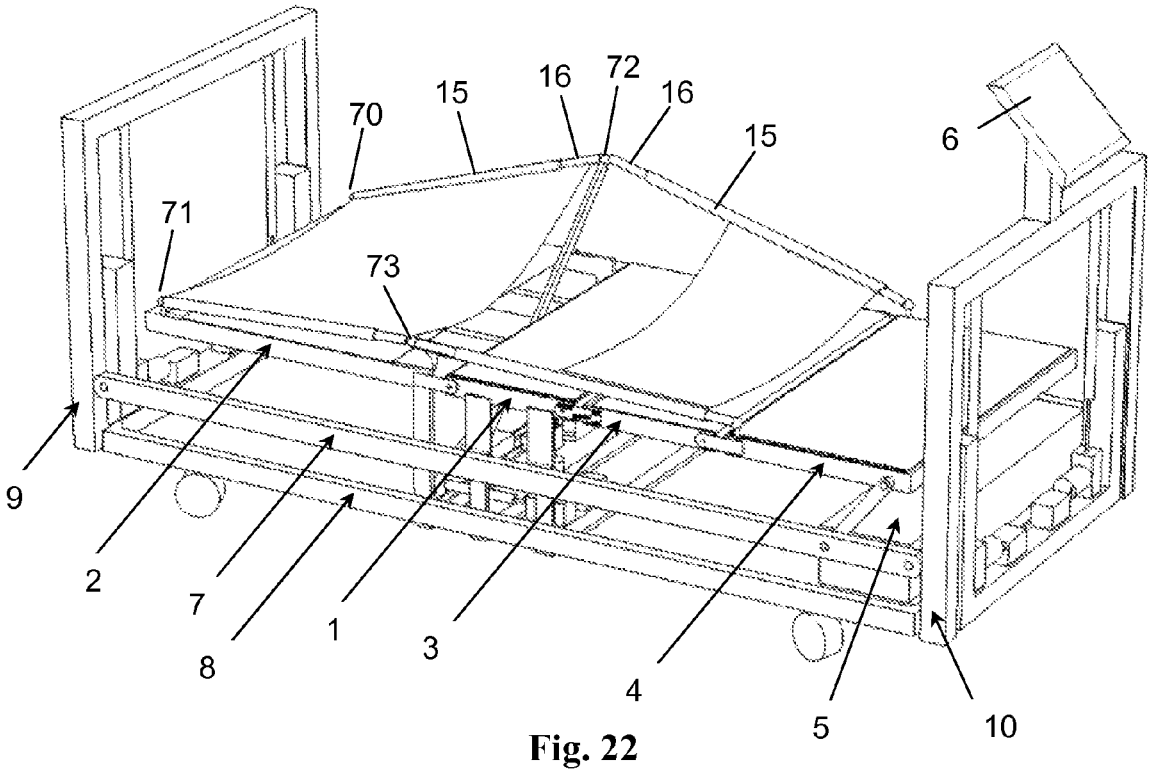
FIG. 22 illustrates the adjustable bed of FIG. 21 in a patient-tilting mode.

FIGS. 21 and 22 illustrate a perspective view of two simplified embodiments of an adjustable bed 100 preferred for home use. Like the previously discussed embodiments, these embodiments comprise an adjustable patient support framework 95 mounted on a base platform 90. But in these embodiments, the adjustable patient support framework 95 has only two independently movable vertices—the right side lower thorax support vertex 72 and the left side lower thorax support vertex 73 (FIG. 22)—and corresponding independently controllable actuator assemblies. These two movable vertices 72 and 73—which are made up of central joints 20e and 20c (FIG. 21), respectively—allow for a degree of rotation of the torso, waist and leg area. The right and left side shoulder support vertices 70 and 71 (FIG. 21), which are made up of superior joints 20*a* and 20*b* (FIG. 22), respectively, are fixedly joined to the torso support base section 2. Besides the side support bars 103 that join the central joints 20*e* and 20*c* to the superior joints 20*a* and 20*b*, additional telescoping side support bars 103—each comprising an inner telescoping rod 16 slidable within an outer rod 15—link the central joints 20*e* and 20*c* to inferior joints 20*a* and 20*b* that are affixed to the lower-leg support structure 4. The embodiments of FIGS. 21 and 22 differ only in the location upon which the lower-leg support structure 4 the inferior joints 20*a* and 20*b* are affixed.

Figure 23:
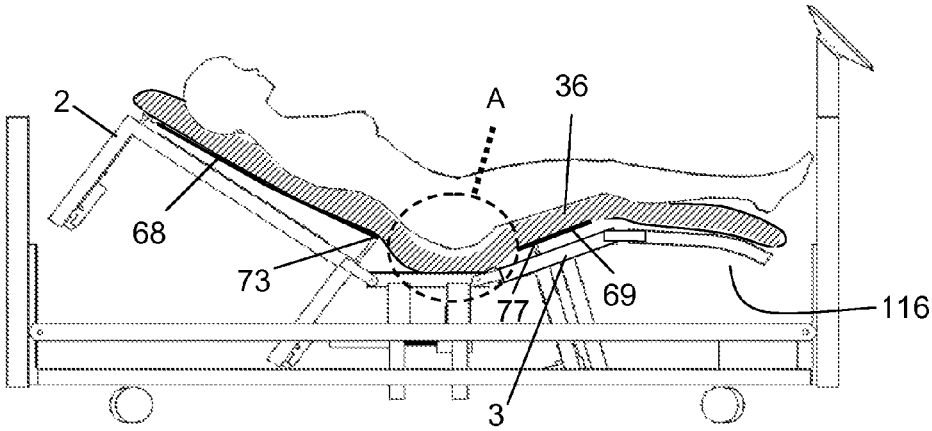
FIG. 23 illustrates a patient support surface being modulated to relieve pressure on a patient's sacral area as well as an alternative embodiment of the lower-leg supporting structure to relieve pressure on the heel area.
Figure 34:
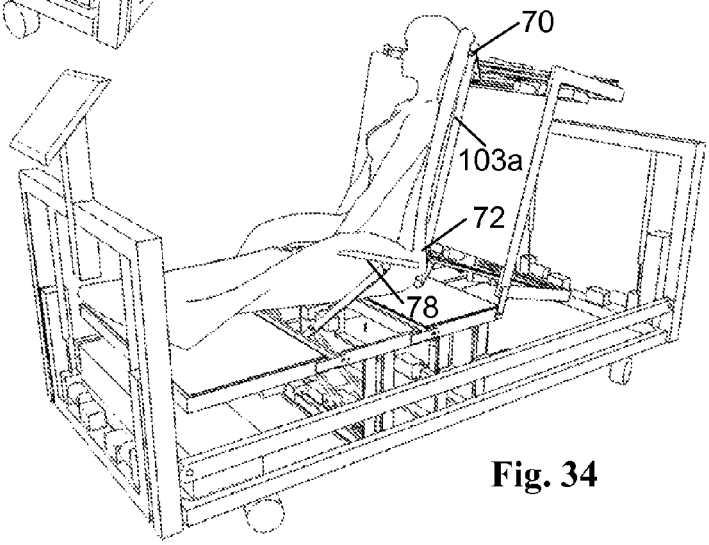
FIG. 34 illustrates the embodiment of FIG. 33 from an alternative perspective view.

FIG. 23 illustrates an embodiment of the adjustable bed 100 with an alternative lower-leg supporting structure 116. In FIG. 34, the upper surface of the lower-leg supporting structure 116 is curved into a concave shape to minimize pressure on the patient's heels, and even to enable the patient's heels to float. This assembly facilitates rapid healing in preexistent pressure ulcers.

Figure 25:
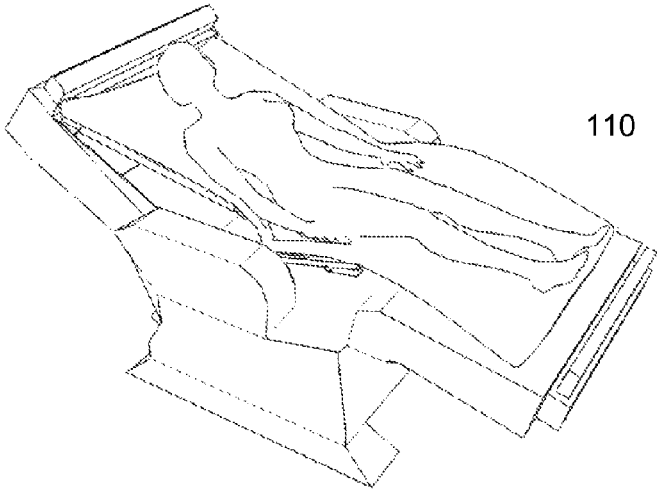
FIG. 25 illustrates a perspective view of an embodiment of the adjustable bed adapted to an airplane seat embodiment.

FIG. 25 provides a perspective view of the adjustable bed 100 in the form of an airplane seat. All the mobility described in the bed embodiment is available for use here in a long distance travel. Here, the leg set may be flexed towards the floor.

Figure 26:
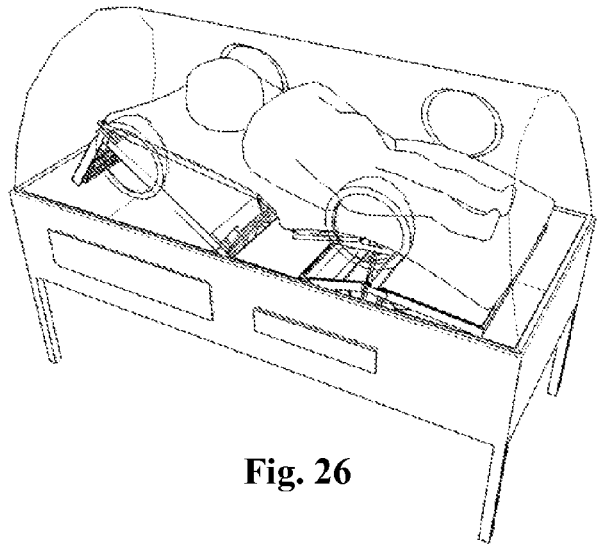
FIG. 26 illustrates a perspective view of an embodiment of the adjustable bed in an incubator embodiment.

FIG. 26 illustrates a perspective view of a miniaturized version of the adjustable bed 100 inside an incubator embodiment. All the mobility described in the bed embodiment is available for stimulation of a new born. It is known that this stimulatory process requires permanent random mobility, which can be obtained easily with this invention.

III. Therapeutic Modes of Operation

The patient support surface 36 of the adjustable bed 100 is modulated and configured through a combination of articulation of the base platform 90 and adjustment of the plurality of independently adjustable vertices (or points) 70-77 and pivotally-connected linking support segments 78, 79, 103*a*, and 103*b* of the adjustable patient support framework 95, all of which are oriented at or near the periphery or perimeter area 81 of the overlying patient support surface 36.

The adjustable patient support framework 95 of the adjustable bed 100 facilitates a wide variety of modulations of the patient support surface 36. FIGS. 23 and 27-34 illustrate several examples of configurations and modulations of the patient support surface 36. In describing the means used to create these configurations, reference is made back to the components illustrated in earlier figures.

Importantly, the independent adjustability of the lower thorax support vertices 72 and 73 relative to the shoulder support vertices 70 and 71 gives the patient support surface 36 a unique ability to hug a patient's waist and elevate the sacral area to significantly reduce interface pressures without any tilting or lateral rotation of the patient. The patient support framework 95 can be modulated to selectively squeeze the periphery of the patient support surface 36 on either side of a patient's waist or hips or both to distribute pressure over a wider area and help maintain the patient in position during other bed movements. It can also be modulated to selectively elevate the torso and hip-supporting areas of the patient support surface 36 relative to a pelvic-supporting area of the patient support surface 36, to thereby relieve pressure in that region.

Figure 28:
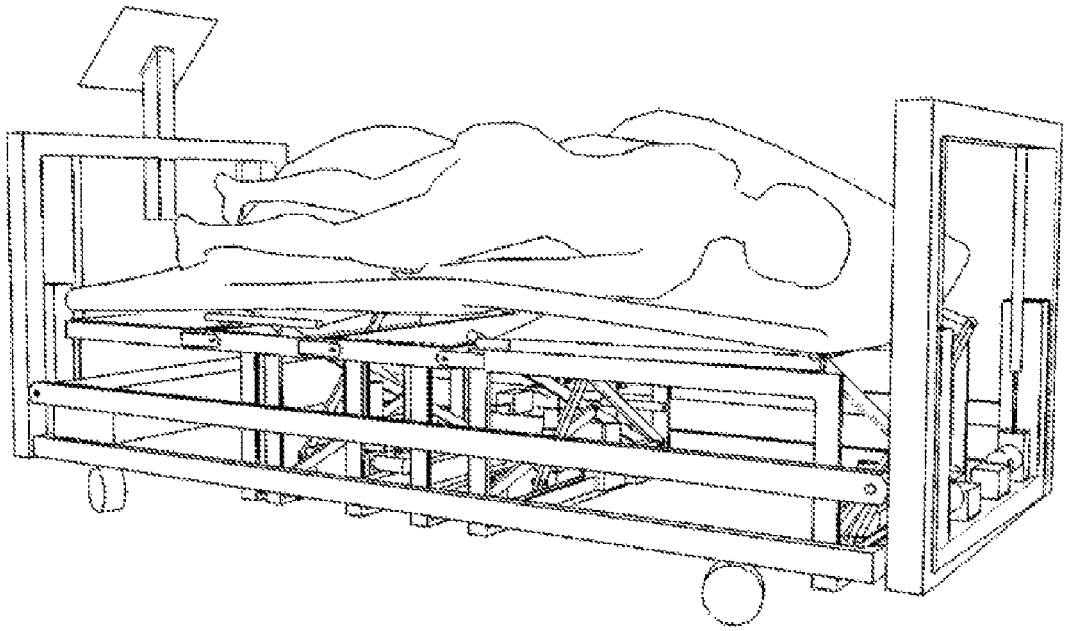
FIG. 28 illustrates a perspective view of the adjustable bed with the patient support surface being modulated to maintain a patient in a prone and rotated position.

The independent adjustability of the lower thorax support vertices 72 and 73 relative to the shoulder support vertices 70 and 71 also gives the patient support surface 36 a unique ability to support a patient in a more physiologically appropriate prone position. In the prone position, pressure sores often develop in the shoulder area. FIG. 28 illustrates a configuration of the adjustable bed 100 that reduces interface pressures on the shoulders of a patient being laterally rotated while in the prone position. The lower thorax support vertices 72 and 73 are selectively and alternately raised far more than the shoulder support vertices 70 and 71.

Figure 27:
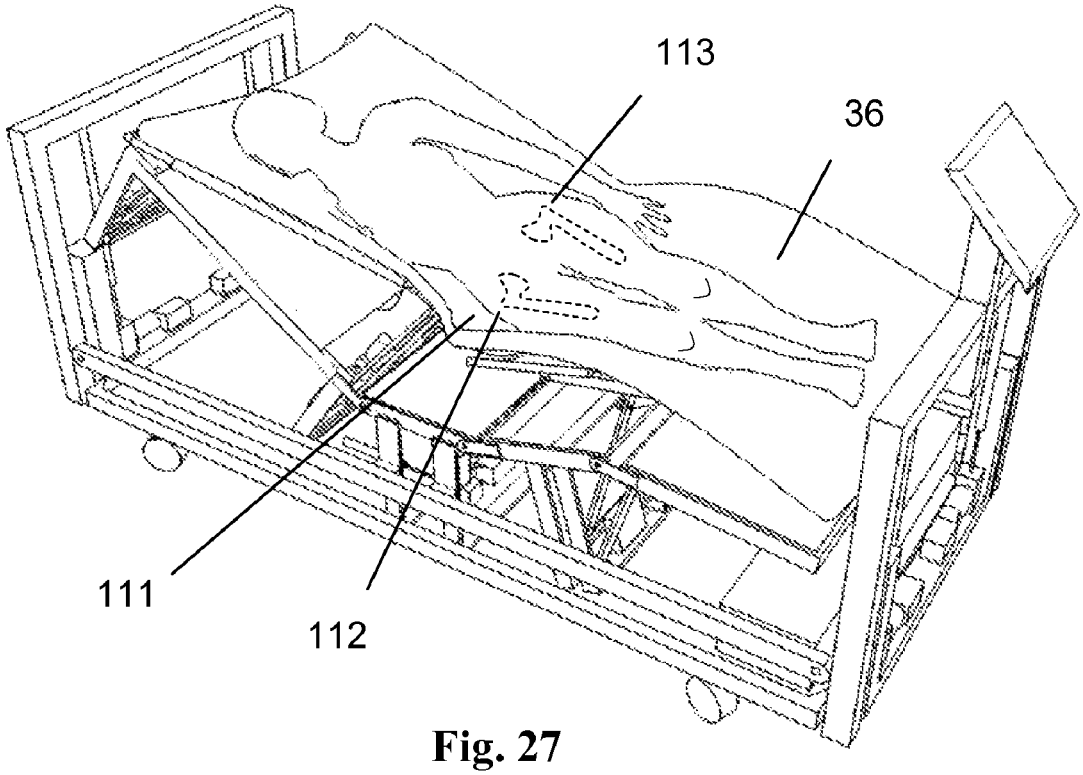
FIG. 27 illustrates a perspective view of the patient support surface being modulated to rotate the patient towards his right side while relieving pressure on the head of right trochanter.

The patient support framework 95 can also be modulated to cause lateral rotation of the patient from side to side, as illustrated in FIG. 27 for a patient in the supine position and in FIG. 28 for a patient in the prone position. This can be accomplished by selectively raising either the left or the right independently movable vertices and segments of the patient support framework 95.

Figure 29:
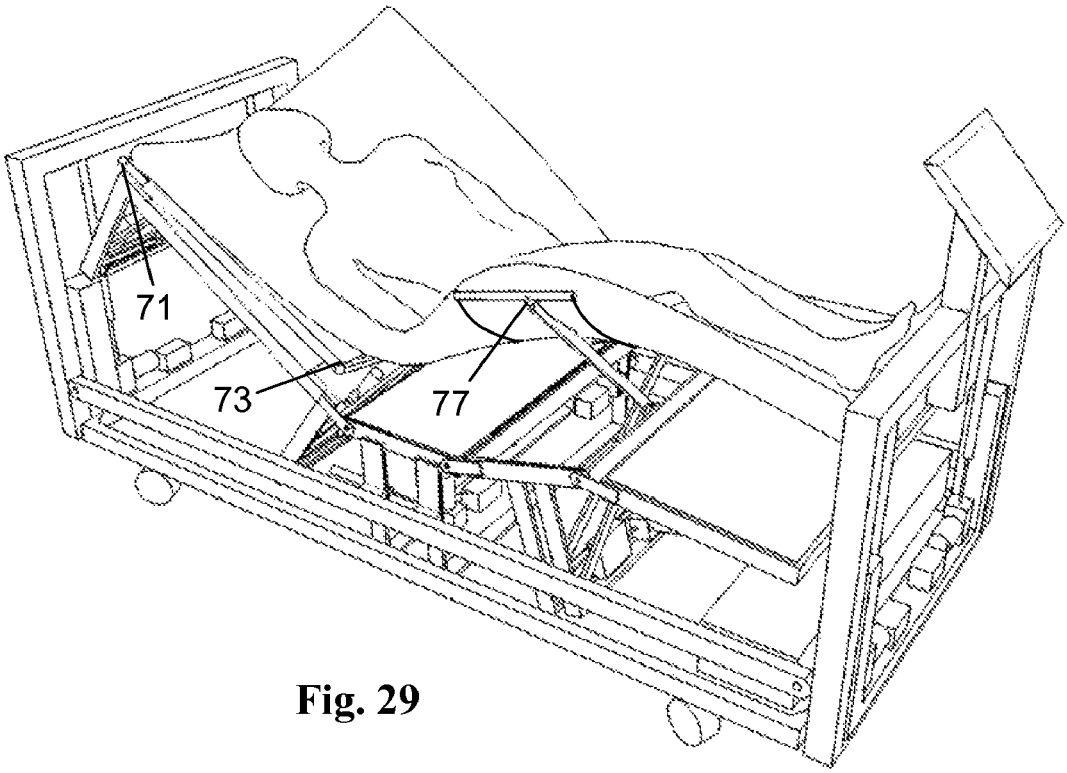
FIG. 29 illustrates a perspective view of the adjustable bed with the patient support surface in a patient-twisting mode to cause counter-rotation of the patient's torso and legs.
Figure 30:
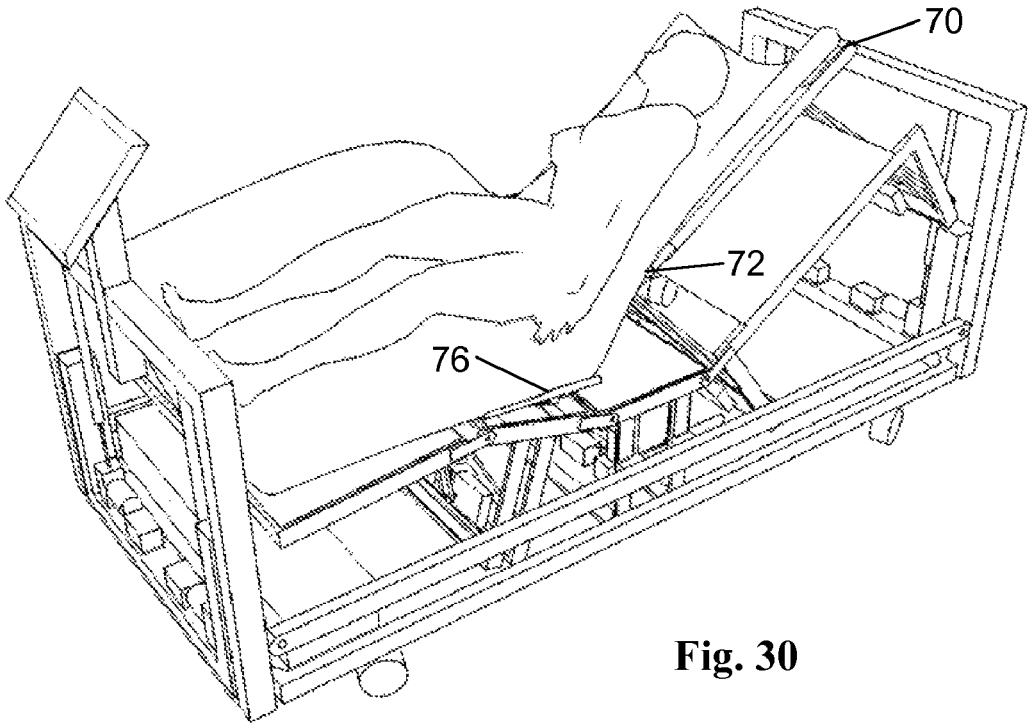
FIG. 30 illustrates the embodiment of FIG. 30 from an alternative perspective view for clarity.

Alternatively, the patient support framework 95 can be modulated to rotate the torso and legs in opposite directions, in a twisting mode, as illustrated in FIGS. 29 and 30. This can be accomplished by selectively raising the right side shoulder and lower thorax support vertices 70 and 72 (relative to the left side shoulder and lower thorax support vertices 71 and 73) while simultaneously selectively raising the left side hip support vertex 77 (relative to the right side hip support vertex 76). This can also be accomplished by selectively raising the left side shoulder and lower thorax support vertices 71 and 73 (relative to the right side shoulder and lower thorax support vertices 70 and 72) while simultaneously selectively raising the right side hip support vertex 76 (relative to the left side hip support vertex 77). A twisting mode may be indicated for patients with multi-fractures or other particular ailments that require the patient's torso and legs to be counter-rotated. The patient support framework 95 can also be modulated to facilitate ingress and egress of a patient onto or off of the patient support surface 36.

These and other desired therapeutic effects can be achieved by acting on the preferably at least six independently movable points or segments of perimeter area, in conjunction with various movements of the articulating torso support base structure 2, hip support base structure 3 and leg support base structure 4. These six lateral points or segments of perimeter area are preferably positioned at or near areas of the patient support surface corresponding to the right shoulder, the left shoulder, the right waist or lower thorax, the left waist or lower thorax, the right hip, and the left hip of a patient resting on the patient support surface. The position of the lower-body supporting section 82 of the patient support surface 36 is indirectly affected by modulation of the other perimeter points or sections. In principle, the greater the number of independently movable vertices, the greater the number of possible configurations into which the patient support surface 36 can be modulated.

A. Selective Squeezing or Holding Mode

Figure 31:
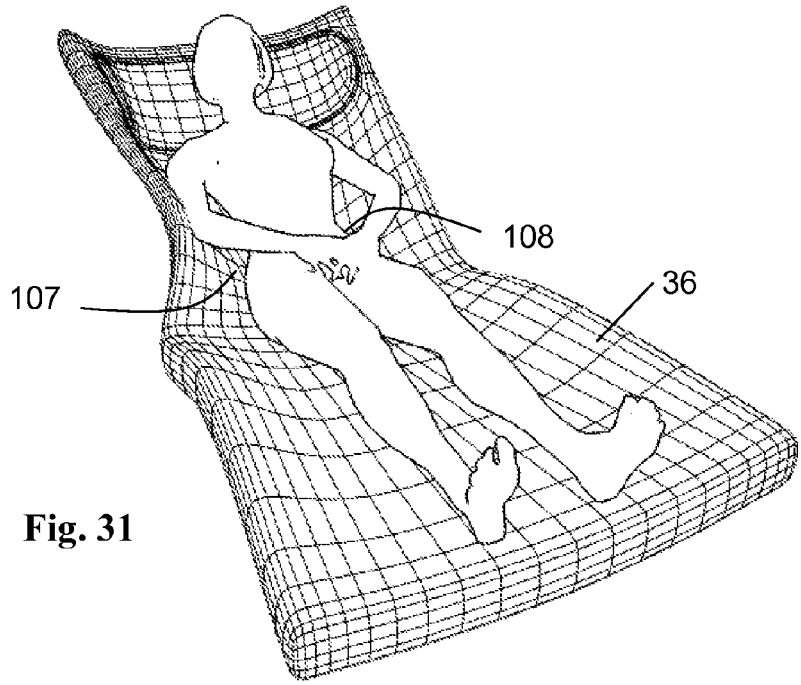
FIG. 31 illustrates a perspective frontal view of the patient support surface being modulated to selectively squeeze the patient support surface on either side of a patient's waist.
Figure 32:
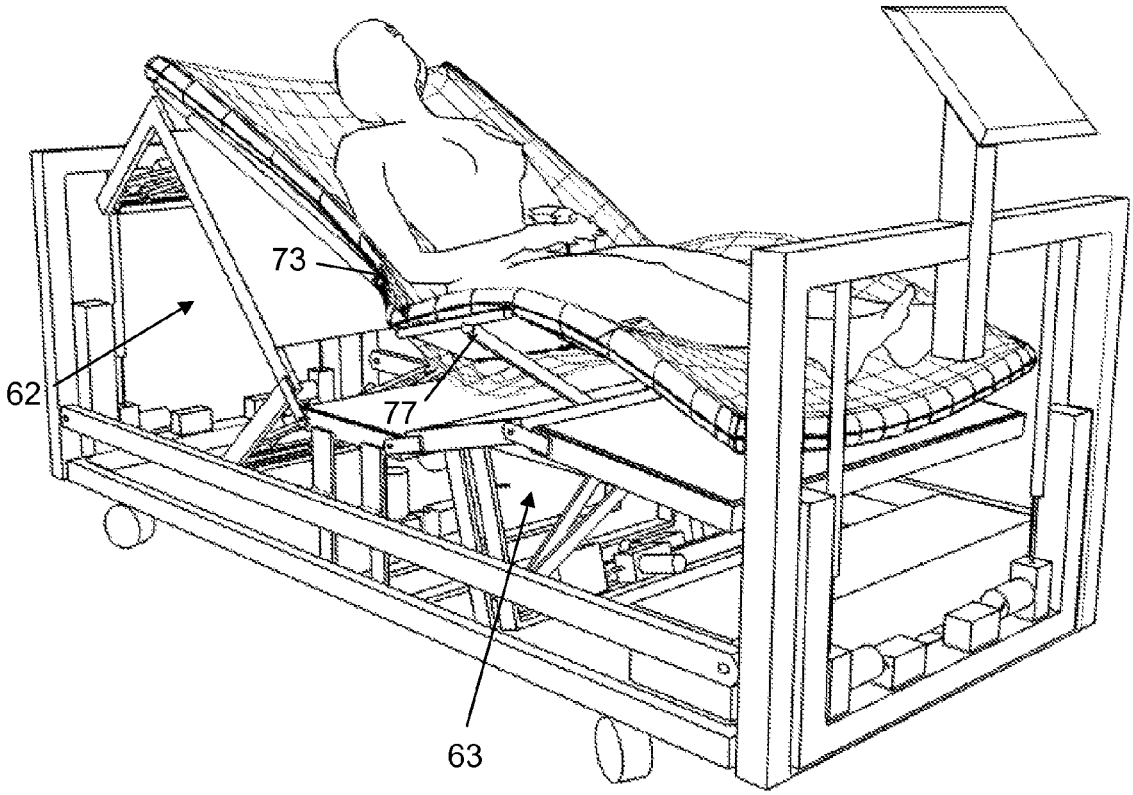
FIG. 32 illustrates the adjustable bed the patient support surface being modulated to selectively squeeze the patient support surface on either side of a patient's waist.

FIGS. 31 and 32 show perspective views of the patient support surface 36 being modulated to selectively squeeze the patient support surface 36 on either side of a patient's waist. In this configuration, the patient's right waist area 107 and left waist area 108 are hugged by the patient support surface 36. This action results from the activity of two of the actuators 11 of the torso support structure 62 to raise and pull inward the right and left lower thorax support vertices 72 and 73. The lower thorax support vertices 72 and 73 move along trajectories between a first relative position of maximum distance between the vertices 72 and 73 and a second relative position in which the vertices 72 and 73 approach the waist of a patient resting on the patient support surface 36. Such action not only significantly reduces interface pressures when the patient is not being rotated, but also inhibits patient movements during lateral rotation and other adjustments of the adjustable bed 100.

This "holding" action of the bed is further enhanced by causing the actuators 11 of the hip support structure 63 to raise and pull inward the right and left side support bars 78 and 79 to selectively squeeze the right-hip-adjacent peripheral portion 123 and the left-hip-adjacent peripheral portion 127 (FIG. 5) of the patient support surface 36. In this manner, the right and left side support bars 78 and 79 also move along trajectories between a first relative position of maximum distance between the left and right support rods 78 and 79 and a second relative position in which the left and right support rods 78 and 79 approach the hips of a patient resting on the patient support surface 36. Such action inhibits a patient resting on the patient support surface 36 from rolling off of the patient support surface 36 during lateral rotation movements and minimizes patient movements during other adjustments of the adjustable bed 100.

If the patient is rotated to any side or submitted to side-to-side rotation, the patient is maintained in that position, without sliding. This not only reduces the danger of shear lesions, but also facilitates a greater degree of rotation of the patient than would otherwise be possible. Moreover, these maneuvers help distribute the patient's load over a wider area.

It should be noted that a selective squeezing of opposite side portions of the patient support surface 36 can be effected through a single actuator operating on both opposite side portions of the patient support surface. Therefore it will be understood that one aspect of the invention covers adjustable beds that use a single actuator to accomplish a selective squeezing operation.

FIG. 27 illustrates a perspective view of a patient resting on a patient support surface 36 that has been modulated to create a trough 111 that prevents the patient from rolling off of the patient support surface 36, and then further modulated to tilt the patient toward one side. When the patient is turned on her/his right side, the head of right trochanter 112 (opposite the patient's left trochanter 113) falls into the trough 111. The trough 111 redistributes the weight of the hip section of the patient over a wider area, relieving pressure on the right trochanter 112. The titled position of the patient relieves pressure on the left trochanter 113. This position results from a combination of torso elevation, selective squeezing of the two inferior actuators 11 of the torso support structure 62, and elevation of the actuators of the hip support structure 63. Similarly, when the patient is turned on her/his left side, the converse happens.

To configure the patient support surface 36 as shown in FIG. 27, the patient is first positioned in the supine position, and facing the ceiling, on the patient support surface 36 while the surface 36 is flat. Next, the articulatable torso support base structure 2 and the articulatable upper-leg support base structure 3 are both rotated upward, moderately, and both of the lower thorax support vertices 72 and 73 and the hip support vertices 76 and 77 are elevated moderately, to create a trough 111. The degree to which these elements are articulated and elevated may vary depending on the size and build of the patient. Once a suitable trough 111 has been created to hold the patient in place, the right side lower thorax support vertex 72 and the right side hip support vertex 76 are elevated significantly more, causing the patient to tilt toward her right side (i.e., toward the left side of the bed from the perspective of one facing the bed).

The patient can be held in this position, without alternating rotation, while still redistributing pressure over a wider surface area of the patient. Alternatively, the right side lower thorax support vertex 72 and the right side hip support vertex 76 may be lowered back to its moderately raised position, and the left side lower thorax support vertex 73 and the left side hip support vertex 77 raised to a significantly elevated position, in order to tilt the patient toward her left side.

The combination of creating a trough and tilting the patient not only improves the pressure relief capabilities of the bed 10, but also significantly reduces the risk of the patient rolling or sliding toward the side of the bed 10.

Figure 35:
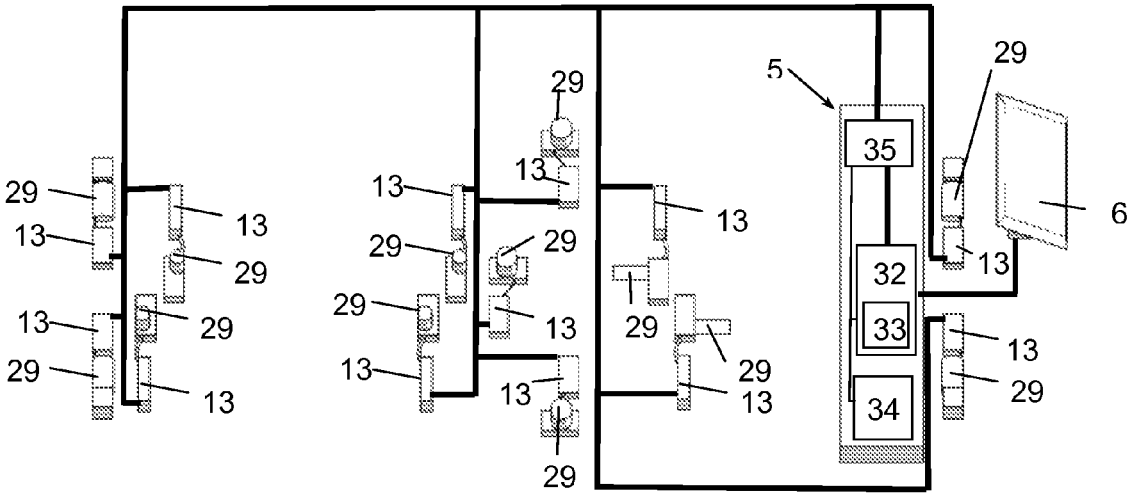
FIG. 35 illustrates a partial top plan view of electrical connections between parts of the adjustable bed.

Preferably, a control and processing unit 5, described further below in connection with FIG. 35, is programmed with a plurality of selective squeezing modes.

In a basic squeezing mode, the control and processing unit 5 is programmed to modulate the intermediate right-side peripheral portion 122, the right-hip-adjacent peripheral portion 123, the intermediate left-side peripheral portion 128, and the left-hip-adjacent peripheral portion 127 of the patient support surface 36 to inhibit a patient resting on the patient support surface 36 from rolling off of the patient support surface 36.

In a patient-tilting mode, the control and processing unit is programmed to simultaneously or sequentially (although not necessarily in the particular order shown below) effect the following modulations of the patient support surface 36:

(a) raise the right-torso-adjacent peripheral portion 121 above the left-torso-adjacent peripheral portion 129 in order to tilt a patient's torso toward one side;

(b) raise the right-calf-adjacent peripheral portion 124 above the left-calf-adjacent peripheral portion 126 in order to tilt a patient's legs toward one side; and (c) raise the left-hip-adjacent peripheral portion 127 to create a trough in the patient support surface for embracing a right hip of a patient resting on the patient support surface 36 and thereby inhibiting the patient from rolling off of the patient support surface 36.

In a patient-twisting mode, the control and processing unit 5 is programmed to simultaneously or sequentially (although not necessarily in the particular order shown below) effect the following modulations of the patient support surface 36:

(a) raise the right-torso-adjacent peripheral portion 121 above the left-torso-adjacent peripheral portion 129 in order to tilt a patient's torso to the left;

(b) raise the left-calf-adjacent peripheral portion 126 above the right-calf-adjacent peripheral portion 124 in order to tilt a patient's legs to the right; and (c) raise both the left-hip-adjacent peripheral portion 127 and the right-hip-adjacent peripheral portion 123 to create a trough in the patient support surface 36 for embracing the hips of a patient resting on the patient support surface 36 and thereby inhibiting the patient from rolling off of the patient support surface 36.

B. Pelvic-Pressure Relief Mode

Figure 24:
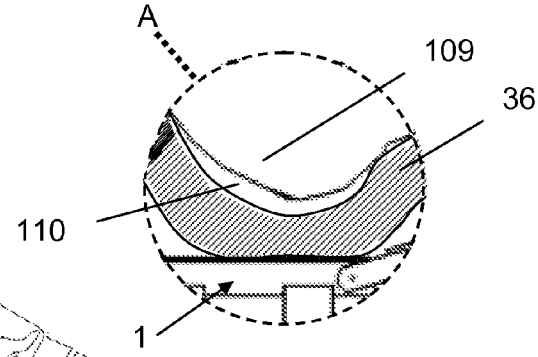
FIG. 24 illustrates a magnified view of a portion of FIG. 23 to illustrate the pressure relief to the sacral area.

FIGS. 23-24 illustrate modulations of the patient support surface 36 to selectively elevate the torso and hip-supporting areas of the patient support surface 36 relative to a pelvic-supporting area of the patient support surface 36, to thereby relieve pressure in that region. This can be accomplished by elevating at least the left and right lower thorax support vertices 72 and 73 of the torso support litter 68 and the right and left side hip support vertices 76 and 77 of the hip support litter 69 sufficiently to substantially reduce pressure on the sacral area of a patient resting on the patient support surface 36.

This action, in combination with the selective squeezing mode, significantly reduces interface pressures. So significant is the reduction in interface pressures that it should, for many patients, prevent pressures sores and eliminate the need for lateral rotation.

It should be noted that embodiments of the adjustable bed 100 could be provided wherein elevation of both left and right lower thorax support vertices 72 and 73 is effected through a single lifting mechanism mounted on the torso support base structure 2. Likewise, embodiments of the adjustable bed 100 could be provided wherein elevation of both the right and left side hip support vertices 76 and 77 are effected through a single lifting mechanism mounted on the hip support base structure 3. Therefore it will be understood that one aspect of the invention covers adjustable beds that just one or two lifting mechanisms to accomplish sacral pelvic-pressure relief mode.

FIG. 23 illustrates a side view of a position for sacral pressure relieve. Support of the patient is exerted mostly by the torso and upper leg area. FIG. 24 is an enlargement view that shows a trough 110 or area of minimal contact between the sacrum 109 and patient support surface 36. This position results from the combined action of torso elevation and operation of the actuators of the hip set to elevate and hug the patient's hips.

Preferably, the control and processing unit 5 has a pre-programmed mode operable to modulate the periphery 81 to raise the patient's sacrum above the patient support surface 36, and thereby relieve pressure on the patient's sacrum. More particularly, this pre-programmed mode is operable to modulate the periphery 81 by raising the right-torso-adjacent peripheral portion 121 and right-hip-adjacent peripheral portion 123 above the intermediate right-side peripheral portion 122, and by raising the left-torso-adjacent peripheral portion 129 and left-hip-adjacent peripheral portion 127 above the intermediate left-side peripheral portion 128.

C. Ingress and Egress-Facilitating Mode

Figure 33:
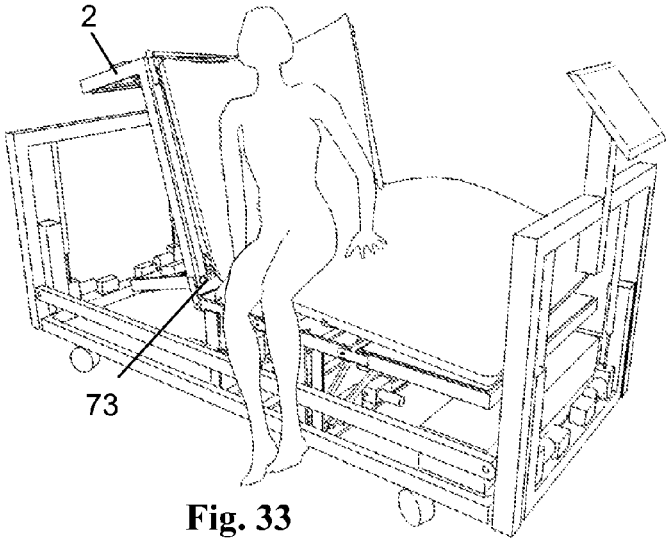
FIG. 33 illustrates a perspective view of the adjustable bed with the patient support surface modulated to facilitate patient ingress or egress on or off the adjustable bed.

FIGS. 33 and 34 illustrate modulations of the patient support surface 36 to facilitate ingress and egress of a patient onto or off of the patient support surface 36. Egress of a patient off of the patient support surface 36 is facilitated by actuation (preferably sequential but alternatively simultaneous) of the following movements: lowering the bed surface as close to the floor as it will go, by lowering the position of the upper chassis 7 relative to the lower chassis 8; articulating the torso support base structure 2 to a substantially upright or chair-like position (e.g., more than 45 degrees, and preferably 60-75 degrees); and tilting the torso support litter 68 toward the right or left, to facilitate patient entry or exit. Meanwhile, the upper-leg and lower-leg support base structures 3 and 4 are maintained in a flat, level position. The upper-leg support litter 69 may also (and preferably simultaneously) be tilted in the same direction as the torso support litter 62, to further facilitate patient entry or exit.

In a prototype embodiment of the adjustable bed 100, the patient support surface 36 may be lowered to within about 41 cm. (or 16 inches), plus the width of the mattress (which is preferably between 2 and 20 cm. thick), from the surface of the floor. This facilitates patient entry and exit much more readily than many prior art therapeutic beds. It is anticipated that future embodiments of the adjustable bed 100 will enable the patient support surface 36 to be lowered even further. The ability of the adjustable bed 100 to lower its patient support surface 36 this close to the ground is one of the benefits of using the innovative actuator 11 designs set forth in this specification.

The step of tilting the torso support base structure 2 entails selectively raising either the right or the left side support bar 103*a* or 103*b* of the torso support structure 62 to moderately tilt the upper-body supporting section 82 (FIG. 5) of the patient support surface 36 to the left or right. Likewise, the step of tilting the hip support base structure 3 entails selectively raising either the right or left side hip support vertex 76 or 77 of the upper-leg and hip support structure 63 to moderately tilt the midsection 83 (FIG. 5) of the patient support surface 36 to the left or right. The pivoting action of the right or left side support bar 78 or 79 on the corresponding right or left side hip support vertex 76 or 77 also helps to twist the patient into an existing position. Actuation of the same movements in reverse facilitates ingress of a patient onto the patient support surface 36. In both cases, patient entry onto, or exit from, the adjustable bed 100 is accomplished with minimal caregiver aid.

The step of tilting the torso support litter 62 can be broken down into two smaller steps. In both steps, both one of the lower thorax support vertices 72 or 73 and one of the shoulder support vertices 70 or 71, on the same right or left side of the bed, are gradually extended away from the torso support base structure 2. In the first step, the lower thorax support vertex 72 or 73 extends more quickly, and farther, than the shoulder support vertex 70 or 71. This maneuver helps twist the patient into an exiting position. During this time, a health care practitioner may take the patient's arm (on the same side being tilted) to help the patient twist into an exiting position. In the second step, the shoulder support vertex 70 or 71 extends more quickly, and ultimately as much as and then even farther, than the lower thorax support vertex 72 or 73. This maneuver helps to push the patient off of the bed. During this time, a health care practitioner may pull on the patient's arm (on the same side being tilted) to help the patient out of the bed. These two steps are reversed to facilitate a patient entering the bed.

It should be noted that embodiments of the adjustable bed 100 could be provided wherein elevation of both right side vertices 70 and 72, or both left side vertices 71 and 73, is effected through a single lifting mechanism mounted on the torso support base structure 2. Therefore it will be understood that one aspect of the invention covers adjustable beds that just one or two lifting mechanisms to accomplish the ingress- or egress-facilitating mode.

The control and processing unit 5 preferably has a pre-programmed mode operable to automatically articulate the torso-support base structure 2 and elevate the appropriate vertices 70-77, in a timed and controlled sequence as set forth above, to facilitate bed ingress or egress.

Stated another way, the control and processing unit 5 preferably has a pre-programmed mode to modulate the right-torso-adjacent peripheral portion 121 and the right-hip-adjacent peripheral portion 123, or alternatively to modulate the left-torso-adjacent peripheral portion 129 and the left-hip-adjacent peripheral portion 127, of the patient support surface 36 to facilitate egress by a patient resting on the patient support surface 36 off of the patient support surface 36. More particularly, this mode is programmed to raise the right-torso-adjacent peripheral portion 121 above the left-torso-adjacent peripheral portion 129, or vice versa, in order to tilt a patient's torso toward one side; and raise the right-hip-adjacent peripheral portion 123 above the left-hip-adjacent peripheral portion 127, or vice versa, in order to tilt a patient's legs toward one side.

IV. Programmable Control of the Bed

FIG. 35 is an abbreviated schematic diagram of electrical connections between various parts of the adjustable bed 100. A control panel 6, which preferably comprises an interactive user interface touch-screen monitor, provides a caregiver the capability to adjust the movable surfaces of the bed into desired positions, and to select pre-programmed routines, or program new routines, of successive movements of the adjustable bed 100. The control panel 6 is connected to a control and processing unit 5. This control and processing unit 5 contains a central processing unit (CPU) 32, a memory 33, a power source 34 and an interface 35 with several peripheral control units 13. Each peripheral control unit 13 drives a defined movement. Moreover, each motor 29 or actuator has a security switch in both ends of the running means to preclude greater displacement than what is allowed.

The control and processing unit 5 also comprises one or more interfaces for connection with an external computer and other instruments and electronic devices. Various patient mobilization routines can be programmed into the control and processing unit 5 and can be administered continuously or episodically by the caregiver through the control panel 6.

In one embodiment the control unit 13 receives from the central processing unit (CPU) 32 movement commands, e.g. positions, velocities and special action, and executes algorithms via an incorporated microcontroller, thus driving each actuator's mechanism to reach the pre-programmed position. The control panel 6 is used to select a routine to trigger a sequence of movements. The CPU 32 then sends to a corresponding control unit 13 the desired position and command information using bidirectional communication protocol. Next the control unit 13 analyzes the position information, determines the difference between the actual position and the desired position, and drives the actuators until the desired position is achieved. Velocity information may also be sent, as defined by the central processing unit 32's algorithm plus the caregiver's input via the control panel 6. In another embodiment, there is no microcontroller in the control unit 13, and the CPU 32 triggers signals to the control unit to the actuators.

The storage memory for the algorithms and position data may be distributed among the CPU 32 and the control units 13. The CPU 32 may have a high storage capacity while each control unit 13 has relatively less storage capacity. The means for CPU storage is capable of collecting a diverse final bed position, e.g. cardiac chair, etc., several sequences of patient movements, e.g. defined trajectories, algorithms for generation of the bed movement programs for prevention and/or treatment activities. The means for CPU storage may be capable of accumulating a clinical history database as well as accumulating clinical treatment results data. The means for CPU storage is capable of adding usage data for the technology described herein, e.g. a record of position information by time.

The control panel 6 also preferably presents intuitive selectable screen menus to the caregiver. The control panel 6 may be capable of having access levels controls, e.g., by password, biometrics, card key, etc. The control panel 6 may have a sector screen to manually direct the actuators, e.g. up, down. In close proximity to the manual mode controls may be a visual indication showing the actual position and the desired position. The control panel 6 may have a portion of the screen that shows a perspective view of the desired position of the bed 100 so that the caregiver has an initial impression of the patient movement desired for confirmation or correction. The control panel 6 may also have an interface screen for inputting individual patient data, e.g. status of consciousness, possible restrictions to movement, previous sites of occurrence of pressure ulcers or lesions, etc., in order to trigger a specific prevention/treatment routine. The control panel 6 may be capable of pausing the routine that is in progress, via access from the patient or caregiver. Algorithms may control the pause duration.

The interface for the control panel 6, in a preferred form, is capable of multimedia output, including, but not limited to, offering audio advice to a caregiver, graphical advices and warnings as warranted. The control panel 6 may include pre-set memory position activators, e.g. buttons. Each button triggers a predetermined final position, e.g. cardiac chair, RX position, eating, resting, etc. The control panel 6 may include customizable memory position activators to save positions desired by a caretaker. The control panel 6 may include trajectory memory activators. A trajectory is defined as a series of predefined positions successively executed from an initial position to a final position. This allows for triggering specific movements of a patient by defined buttons, e.g. bed egress and bed ingress as an aid to a caregiver. The control panel 6 may include means to activate a diurnal mode, i.e. more accelerated, and a nocturnal mode, i.e. slower. This capability may be set automatically as a function of clock information, or may be set manually by a patient.

The control panel 6 may contain a special CPR button for use in an emergency. Activating this CPR button triggers signals for a rapid descending of all actuator mechanisms. The control panel 6 may contain a special button for pausing of a movement in progress. Activating this pause button freezes all movements of the technology described herein. Subsequent activation of the pause button results in returning to the movement in progress. If the pause button is not reactivated there may be a return to the movement in progress after a pre-established time for ulcer prevention has passed. The control panel 6 may contain a special stop button to stop the movement in progress.

The control panel 6 may have the capability of allowing connection of a remote control for use by a patient. The connection between the control panel 6 and the remote control may be wired or wireless. The remote control may have reduced functionality and may be configurable to address different needs. The control panel 6 may contain means to activate a remote operation of the bed 100. This capacity may permit, e.g. via the Internet, total or partial control of the bed and total or partial access to the collected data. The control panel 6 may contain means for an audio-video connection, e.g. via the Internet, so that a visitor may have access in real time to audio and images of the patient. The control panel 6 may contain means to show the pressure value sensed via a special attachment for patient-to-mattress pressure determination. The control panel 6 may have the capability for the addition of specific controls to other accessories engaging the bed 100, e.g. motorized rail, proning attachment, etc.

The technology described herein may include a black box recording unit that documents parameters of usage. This black box may be used for maintenance needs or technical service, thus reducing outside operation time. The black box may provide information to a caregiver about the intensity of recent use that is related to a prevention/treatment action. The black box may be capable of permitting a pay system based on use. The black box may collect data for future analysis and development, thus providing relationships between a patient's diagnosis and best preventive or treatment programs.

The technology described herein may include algorithms controlling sequences of movements and executed from the control panel by a caregiver or patient. Each algorithm may contain all the information needed to execute a defined flow of movements. In one embodiment of the technology described herein a caregiver may have the ability to create his own algorithmic sequences, adapted to the specific needs of an individual patient. The newly generated sequences may remain stored in memory for evaluation and future usage. The CPU 32's algorithms may be directed to executing trajectories, generating movement flows, previewing movements, precluding mechanical interferences, establishing control units communication, modulating diurnal or nocturnal movement flows, determining index of use, documenting bed activity, etc. The control unit 6's algorithms may be directed to establishing communication with the CPU 32, driving actuators, sensing position, and synchronizing the advance of parallel actuators.

V. Conclusion

Having thus described exemplary embodiments of the present invention, it should be noted that the disclosures contained in FIGS. 1-35 are exemplary only, and that various other alternatives, adaptations, and modifications may be made within the scope of the present invention. For example, the adjustable bed 100 may be further adapted as set forth in U.S. patent application Ser. No. 12/120,363, filed on May 14, 2008, and entitled "Adjustable Bed With Sliding Subframe for Torso Section," and U.S. patent application Ser. No. 12/176,338, filed on Jul. 19, 2008 and entitled "Side Guard for Bed," both of which are herein incorporated by reference. Accordingly, the present invention is not limited to the specific embodiments illustrated herein, but is limited only by the following claims.

This invention also relates to, and this application incorporates herein by reference, the following disclosures filed as part of the Patent and Trademark Office's Document Disclosure Program: the disclosure by Eduardo R. Benzo and Rodolfo W. Ferraresi entitled Levita-Bed System, received by the Patent and Trademark Office ("PTO") on Dec. 27, 2005, and assigned document number 592241; the disclosure by Eduardo R. Benzo, Rodolfo W. Ferraresi, and Mario C. Eleonori entitled Dynamic Multipositional Hospital Bed, received by the PTO on Feb. 27 2006, and assigned document number 596795; the disclosure by Eduardo R. Benzo, Rodolfo W. Ferraresi, and Mario C. Eleonori entitled Dynamic Multipositional Hospital Bed, received by the PTO on Jul. 19, 2006, and assigned document number 603707; the disclosure by Eduardo R. Benzo, Rodolfo W. Ferraresi, and Mario C. Eleonori entitled Use and Control Methods for Multipositional Beds, received by the PTO on Dec. 13, 2006, and assigned document number 610034; and the disclosure by Eduardo R. Benzo, Rodolfo W. Ferraresi, and Mario C. Eleonori entitled System for Virtual Communication between Patient and the Rest, received by the PTO on Dec. 13, 2006, and assigned document number 610042.

We claim:

1. An adjustable bed comprising:

a patient support surface;

a patient support structure that supports and modulates the patient support surface;

the patient support structure having a torso support structure, a pelvic support structure, an upper-leg support structure, and a lower-leg support structure; and lifting mechanisms operable, in a pressure-relief mode comprising a coordinated sequence of programmed movements, to elevate the torso and upper-leg support structures relative to the pelvic support structure, so that vertical gaps are formed between the torso support structure and the pelvic support structure and between the upper-leg support structure and the pelvic support structure in order to create a trough in the patient support surface that substantially reduces pressure on the sacral area of a patient resting on the patient support surface.

2. The adjustable bed of claim 1, wherein the lifting mechanisms are further operable, in the pressure-relief mode, to tilt the patient support surface to one side while maintaining the trough, whereby the trough in the tilted patient support surface substantially reduces pressure on the trochanter head of a patient lying on the patient support surface.

3. The adjustable bed of claim 1, wherein the patient support structure comprises a plurality of independently adjustable vertices mounted on a base platform that support and are operable to modulate the patient support surface, and wherein the pressure-relief mode comprises programmed movements to elevate and draw inward selected ones of these independently adjustable vertices in order to create a trough in the patient support surface.

4. The adjustable bed of claim 1, wherein the torso support structure comprises right and left lower thorax support vertices mounted on an articulating torso support base structure and operable to modulate the patient support surface;

wherein a first one of the lifting mechanisms is operable to articulate the torso support base structure relative to the pelvic support structure;

wherein one or more of the remaining lifting mechanisms are operable to move the right and left lower thorax support vertices along upward and inward trajectories to elevate the lower thorax of a patient lying on the patient support surface;

wherein the pressure-relief mode includes a programmed movement to articulate the torso support base structure and another programmed movement to move the right and left lower thorax support vertices along upward and inward trajectories.

5. The adjustable bed of claim 4, wherein the torso support structure further comprises independently controllable right and left shoulder support vertices mounted on the articulating torso support base structure;

wherein the pressure-relief mode includes programmed movements to raise the right and left lower thorax support vertices along upward and inward trajectories while keeping the right and left shoulder support vertices stationary.

6. The adjustable bed of claim 5, wherein the upper-leg support structure comprises right and left upper-leg support vertices mounted on an articulating upper-leg torso support base structure and operable to further modulate the patient support surface;

wherein a second one of the lifting mechanisms is operable to articulate the upper leg support base structure relative to the pelvic support structure; and wherein one or more of the remaining lifting mechanisms are operable to move the right and left upper-leg support vertices along upward and inward trajectories to elevate the upper legs of a patient lying on the patient support surface;

wherein the pressure-relief mode includes a programmed movement to articulate the upper-leg support base structure and another programmed movement to move the right and left upper-leg support vertices along upward and inward trajectories.

7. The adjustable bed of claim 5, wherein the upper-leg support structure further comprises right and left upper-leg support bars pivotally mounted on the right and left upper-leg support vertices, the pivotal mounting allowing the patient support surface to conform more closely to a patient's body contour.

8. The adjustable bed of claim 1, wherein the torso, upper-leg, and lower-leg support structures are each operable to articulate about separate transverse axes.

9. The adjustable bed of claim 1, wherein the torso support structure comprises an adjustable torso support litter mounted on at least one torso-support-section lifting mechanism, which is in turn mounted on a torso-support base structure, wherein the pressure-relief mode includes a programmed movement to articulate the torso support base structure and another programmed movement to elevate and draw inward the torso support litter.

10. The adjustable bed of claim 1, wherein the upper-leg support structure comprises an adjustable hip support liner mounted on at least one upper-leg support-section lifting mechanism, which is in turn mounted on an upper-leg support base structure, wherein the pressure-relief mode includes a programmed movement to articulate the upper-leg support base structure and another programmed movement to elevate and draw inward the upper-leg support litter.

11. An adjustable bed comprising:

a base platform;

an adjustable patient support framework mounted on the base platform;

a patient support surface, for supporting a patient, mounted on the adjustable patient support framework;

the patient support surface having a periphery;

the adjustable patient support framework comprising pairs of independently adjustable vertices symmetrically disposed on left and right sides of the patient support surface at or near the periphery of the patient support surface; and for each of the plurality of independently adjustable vertices, an independently controllable actuator coupled to and operable to independently modulate that vertex;

wherein modulation of the patient support surface is operable to be effected in part through adjustment of the plurality of independently adjustable vertices oriented at or near the periphery of the patient support surface; and a control and processing unit programmed, in a pressure-relieving mode, to simultaneously elevate and draw inward a selected pair of said independently adjustable vertices in order to create a trough in the patient support surface.

12. The adjustable bed of claim 11, wherein the control and processing unit is further programmed, in the pressure-relieving mode, to selectively raise portions of the patient support surface underlying the lower thorax and upper legs of a patient lying on the patient support surface, in order to create a trough in an intermediate portion of the patient support surface underlying the sacrum of the patient, to thereby relieve pressure on the patient's sacrum.

13. The adjustable bed of claim 11, wherein the control and processing unit is further programmed, in the pressure-relieving mode, to tilt the patient support surface to one side while maintaining the trough, whereby the trough in the tilted patient support surface substantially reduces pressure on the trochanter head of a patient lying on the patient support surface.

14. The adjustable bed of claim 11, wherein:

the base platform includes an articulating torso support base structure driven by a lifting mechanism;

the adjustable support framework comprises right and left lower thorax support vertices mounted on the articulating torso support base structure and operable to modulate the patient support surface;

each of the one or more independently controllable actuators comprises a plurality of moving parts whose movements, relative to the torso support base structure, are confined to a transverse plane perpendicular to a longitudinal axis of the torso support base structure;

the one or more independently controllable actuators are operable to move the right and left lower thorax support vertices along upward and inward trajectories to elevate the lower thorax of a patient lying on the patient support surface; and wherein the pressure-relieving mode includes a programmed movement to articulate the torso support base structure and another programmed movement to move the right and left lower thorax support vertices along upward and inward trajectories.

15. An adjustable bed comprising:

a multi-sectioned base platform comprising first, second, third and fourth base structures positioned to underlie a torso region, a pelvic region, an upper leg region, and a lower leg region, respectively, of a patient resting on the adjustable bed;

an adjustable torso support litter mounted over the first base structure, the adjustable torso support litter having inferior and superior right-side vertices and inferior and superior left-side vertices and a flexible mattress-supporting foundation mounted between the right-side vertices and the left-side vertices and suspended above the first base structure;

one or more torso litter actuators mounted on the first base structure and coupled to and operable to raise the inferior right-side vertex and inferior left-side vertex relative to the first section;

adjustable right and left side support bars mounted on the third base structure;

an adjustable upper-leg-support litter mounted between the right and left side support bars on the third base structure;

one or more upper-leg-support litter actuators mounted on the third base structure and coupled to and operable to raise the right and left side support bars relative to the third base structure;

a patient support surface, for supporting a patient, resting over the torso-support litter and upper-leg-support litter; and a control and processing unit programmed, in a pressure-relief mode, to raise the torso and upper-leg support litters to create a trough in the patient support surface that relieves pressure on the patient's sacrum.

16. The adjustable bed of claim 15, wherein the first, third and fourth base structures of the base platform are operable to be articulated.

17. The adjustable bed of claim 16, wherein the adjustable torso support litter is operable to be modulated independently of any articulation of the first base structure.

18. The adjustable bed of claim 17, wherein the adjustable upper-leg-support litter is operable to be modulated independently of any articulation of the third base structure.

19. The adjustable bed of claim 15, further characterized in there being at least two independently controllable torso liner actuators, one of which is coupled to and operable to raise the inferior right-side vertex independently of the inferior left-side vertex, and the other of which is coupled to and operable to raise the inferior left-side vertex independently of the inferior right-side vertex.

20. The adjustable bed of claim 19, further characterized in there being at least two independently controllable upper-leg-support litter actuators, one of which is coupled to and operable to raise the right side support bar independently of the left side support bar, and the other of which is coupled to and operable to raise the left side support bar independently of the right side support bar.

* * * * *